US005228088A

United States Patent [19]

Kane et al.

[11] Patent Number: 5,228,088

[45] Date of Patent: Jul. 13, 1993

[54] VOICE SIGNAL PROCESSOR

[75] Inventors: Joji Kane, Nara; Akira Nohara, Nishinomiya, both of Japan

[73] Assignee: Matsushita Electric Industrial Co., Ltd., Osaka, Japan

[21] Appl. No.: 706,574

[22] Filed: May 28, 1991

[30] Foreign Application Priority Data

May 28, 1990 [JP] Japan ..... 3-138056
May 28, 1990 [JP] Japan ..... 3-138057
May 28, 1990 [JP] Japan ..... 3-138058

[51] Int. Cl.[5] ..... G10L 5/00
[52] U.S. Cl. ..... 381/47
[58] Field of Search ..... 381/36, 37, 47; 395/2

[56] References Cited

FOREIGN PATENT DOCUMENTS

WO87/00366 1/1987 PCT Int'l Appl. .
WO87/04294 7/1987 PCT Int'l Appl. .

OTHER PUBLICATIONS

"Cepstrum Pitch Determination", A. Michael Noll, Bell Telephone Laboratories, Murray Hill, N.J., The Journal of the Acoustical Society of America, Aug. 1966, pp. 293–309.

"Separation of Speech from Interfering Speech by Means of Harmonic Selection", Thomas W. Parsons, J. Acoust. Soc. Am., vol. 60, No. 4, Oct. 1976, pp. 911–918.

"Noisy Speech Enchancement: A Comparative Analysis of Three Different Techniques", Audisio et al., 53(1984) Maggio–giugno, No. 3, Milano, Italia, pp. 190–195.

"Algorithms for Separating the Speech of Interfering Talkers: Evaluations with Voiced Sentences, and Normal–Hearing and Hearing Impaired Listeners", Stubbs et al., J. Acoust. Soc. Am. 87(1), Jan. 1990, pp. 359–372.

*Primary Examiner*—Emanuel S. Kemeny
*Attorney, Agent, or Firm*—Wenderoth, Lind & Ponack

[57] ABSTRACT

A voice signal processor features a particular improvement of the S/N ratio. In the voice signal processor, the signal level in the voice band of a signal from which noise is cancelled to some extent is emphasized relative to the signal level in the noise band. Moreover, a cancellation factor is utilized in cancelling the noise, so that the voice level in the voice band is emphasized, or the noise level in the noise band is attenuated, achieving a better noise-suppressed voice signal.

15 Claims, 24 Drawing Sheets input waveform
A
t predicting
noise waveform
B
t input waveform
spectrum
A
fourier transformer
f predicting noise
spectrum
B
f subtract A − B
f output waveform
(A − B)
invert fourier
transformer
t

VOICE SIGNAL PROCESSOR

BACKGROUND OF THE INVENTION

1. Field of the Invention

The present invention relates to a signal processor utilizable, for example, in processing voice signals.

2. Description of the Prior Art

FIG. 25 is a block diagram of a conventional signal processing apparatus. In FIG. 25, a filter controller 1 distinguishes a voice component and a noise component in a signal input thereto, that is, controls a filtration factor of a bank of band-pass filters 2 (hereinafter referred to as a BPF bank) corresponding to the voice or noise component of the input signal. The BPF bank 2 is followed by an adder 3 which divides the input signal into frequency bands. The passband characteristic of the input signal is determined by a control signal from the filter controller 1.

The conventional signal processing apparatus of the above-described construction operates as follows.

When an input signal having the noise component superposed on the speech component is supplied to the filter controller 1, the filter controller 1 subsequently detects the noise component from the input signal in correspondence to each frequency band of the BPF bank 2, so that a filtration factor for not allowing the noise component to pass through the BPF bank 2 is supplied to the BPF bank 2.

The BPF bank 2 divides the input signal appropriately into frequency bands, and passes the input signal with the filtration factor set for every frequency band by the filter controller 1 to the adder 3. The adder 3 mixes and combines the divided signal so as to thereby obtain an output.

In the aforementioned manner, conventionally, the level of the input signal in the frequency band including the noise component is lowered, and as a result of this, an output signal having an attenuated noise component is obtained.

According to the aforementioned manner, however, some noise components still remain to be removed.

Moreover, according to the conventional method, the noise component is distinguished from the voice component simply in time sequence. The noise component and voice component in the signal are attenuated or amplified in its entirety, and therefore the S/N ratio is not particularly enhanced.

SUMMARY OF THE INVENTION

An essential object of the present invention is to provide a voice signal processor which can achieve effective suppression of noise, while improving the S/N ratio, with an aim to eliminate the above-discussed disadvantages inherent in the prior art.

In accomplishing the above-described object, a voice signal processor of the present invention is provided with: a band dividing means for dividing an input signal mixed with noise into frequency bands; a voice band detecting means for detecting a portion in the voice band of the divided signal for each frequency band; a voice band selecting/emphasizing means for emphasizing, on the basis of the voice band information detected by the voice band detecting means; a voice signal band of the noise-mixed signal relative to a noise signal band; and a band synthesizing means for combining the signal emphasized by the voice band selecting/emphasizing means.

According to the voice signal processor of the aforementioned structure, the voice signal band is emphasized relative to the noise signal band, i.e., the signal level in the voice signal band is enhanced or that in the noise signal band is decreased.

According to a further aspect of the present invention, a voice signal processor is provided with: a band dividing means for dividing an input signal mixed with noise into frequency bands; a voice discriminating means for discriminating a voice portion in the signal divided by the band dividing means; a noise predicting means for predicting noise in the voice portion using the voice portion information obtained by the voice discriminating means; a cancelling means for subtracting a value of the predicted noise from the divided signal; a voice band detecting means for detecting a portion in the voice band of the divided signal for every frequency band; a voice band selecting/emphasizing means for emphasizing a voice signal band relative to a noise signal band of the signal from which noise is cancelled by the cancelling means; and a band synthesizing means for synthesizing the signal emphasized by the voice band selecting/emphasizing means.

In the above-described structure, the voice signal band is emphasized relatively to the noise signal band, so that the noise in the input signal can be effectively suppressed.

According to a yet further aspect of the present invention, a voice signal processor is provided with: a band dividing means for dividing an input voice signal including noise into frequency bands; a noise predicting means for predicting a noise component of an output of the band dividing means input thereto; a pitch frequency detecting means for detecting a pitch frequency of the input signal including noise; a cancellation factor setting means for setting a cancellation factor corresponding to the pitch frequency output from the pitch frequency detecting means; a cancelling means into which are input an output from the noise predicting means, an output from the band dividing means, and a cancellation factor signal from the cancellation factor setting means for cancelling a noise component in consideration of the cancelling rate from the output of the band dividing means; a voice band detecting means for detecting a portion in the voice band of the input signal using the pitch frequency detected by the pitch frequency detecting means; a band selecting/emphasizing/controlling means for outputting a control signal to emphasize the voice band detected by the voice band detecting means; a voice band selecting/emphasizing means for emphasizing a voice signal band relative to a noise signal band of the signal from which noise is cancelled by the cancelling means; and a band synthesizing means for synthesizing the signal emphasized by the voice band selecting/emphasizing means.

In the above-described construction of the voice signal processor, the voice signal band of the signal from which noise is cancelled is emphasized relative to the noise signal band, thereby enhancing the S/N ratio.

The present invention still features a voice signal processor which is provided with: band dividing means for dividing an input voice signal including noise into frequency bands; a noise predicting means for predicting a noise component of an output input thereto from the band dividing means; a pitch frequency detecting means for detecting a pitch frequency of the input signal including noise; a cancellation factor setting means for setting a cancellation factor corresponding to the pitch frequency detected by the pitch frequency detecting means; a cancelling means into which are input an output from the noise predicting means, an output from the band dividing means, and a cancellation factor signal set by the cancellation factor setting means for cancelling the noise component from the output of the band dividing means in consideration of the cancelling rate; a voice band detecting means for detecting a voice band to detect a portion in the voice band of the input signal using the pitch frequency detected by the pitch frequency detecting means; a noise band calculating means for calculating a noise band on the basis of the voice band information detected by the voice band detecting means; a band selecting/attenuating/controlling means for outputting a control signal to attenuate the noise band calculated by the noise band calculating means; a noise band selecting/attenuating means for selecting the noise band of the signal input thereto from which noise is cancelled by the cancelling means in compliance with the control signal of the band selecting/attenuating-/controlling means, so as to thereby attenuate the noise band only, and a band synthesizing means for synthesizing the signal attenuated by the noise band selecting/attenuating means.

According to the voice signal processor of the above-described structure, the noise signal band is attenuated relative to the voice signal band, thereby improving the S/N ratio.

BRIEF DESCRIPTION OF THE DRAWINGS

This and other objects and features of the present invention will become apparent from the following description taken in conjunction with preferred embodiments thereof with reference to the accompanying drawings, in which.

DESCRIPTION OF THE PREFERRED EMBODIMENTS

Figure 1:
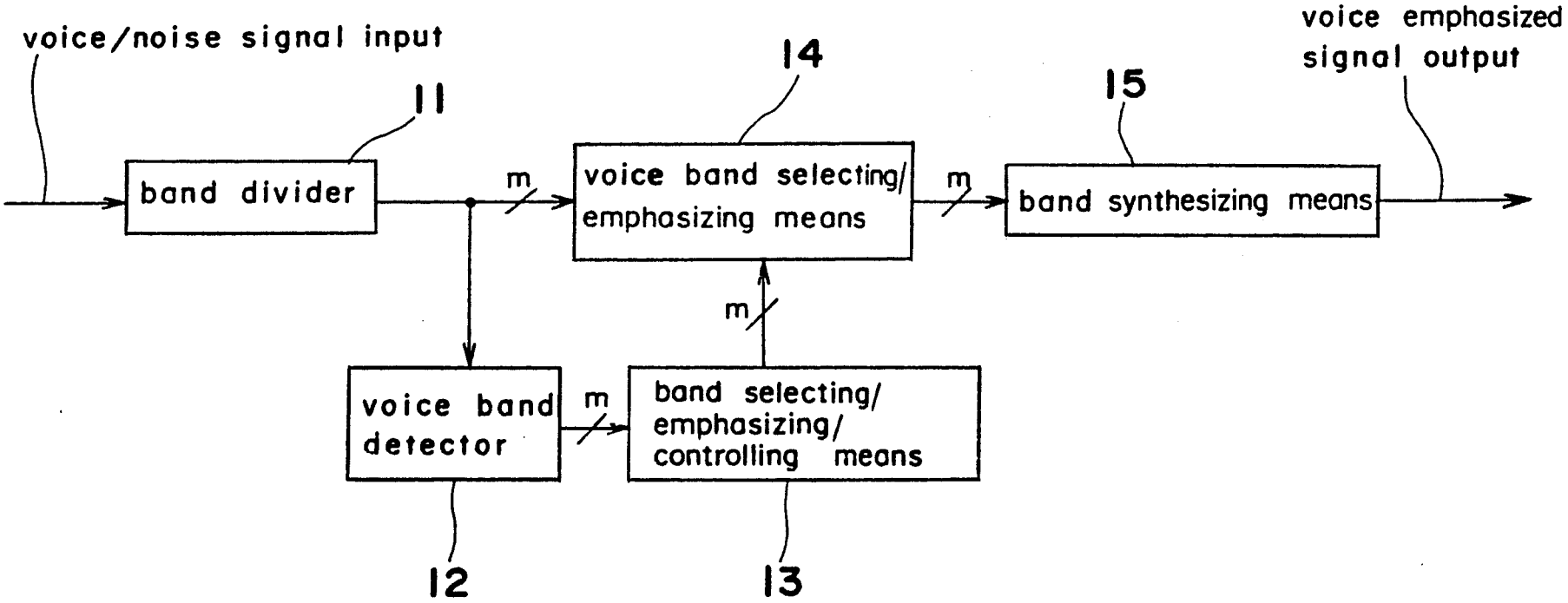
FIG. 1 is a block diagram of a voice signal processor according to a first embodiment of the present invention.

Before the description of the present invention proceeds, it is to be noted here that like parts are designated by like reference numerals throughout the accompanying drawings.

Furthermore, the terms voice band and voice channel are synonymous throughout the specification and claims. Similarly, the emphasizing means and gain modifying means are synonymous as are the terms band synthesizing means and channel controller means.

A voice signal processor of the present invention will be discussed hereinbelow with reference to the accompanying drawings.

Referring to FIG. 1 of a block diagram of a voice signal processor according to a first embodiment of the present invention, a band dividing means 11 A/D converts and Fourier-transforms a mixed signal of voice and noise input thereto.

A voice band detecting means or voice band detector 12, upon receiving the mixed signal including noise from the band dividing means or band divider 11, detects the frequency band of a voice signal portion of the mixed signal. For example, the voice band detecting means 12 detects the frequency band where the voice signal exists using the Cepstrum analysis described later. The relationship from a frequency point of view between the voice band and noise band is generally as indicated in a graph of FIG. 21, in which S represents the voice signal band, N being the noise band. The voice band detecting means 12 detects this band S.

A band selecting/emphasizing/controlling means 13 outputs a control signal to emphasize the voice band based on the voice band information obtained by the voice band detecting means 12.

A voice band selecting/emphasizing means 14 to which is input the signal including noise from the band dividing means 11 selects the voice band and emphasizes the voice band only in accordance with the control signal of the controlling means 13.

A band synthesizing means 15 combines and synthesizes the signal emphasized by the voice band selecting-/emphasizing means 14.

The operation of the voice signal processor according to the first embodiment will be discussed hereinbelow.

The band dividing means 11 divides the voice signal mixed with noise into frequency bands. The voice band of the signal in the band dividing means 11 is detected by the voice band detecting means 12. The band selecting/emphasizing/controlling means 13 generates a control signal based on the information of the voice band obtained by the detecting means 12. The level of the signal in the voice band is emphasized by the control signal from the controlling means 13. Then, the noise-mixed voice signal the level of which is emphasized by the emphasizing means 14 is synthesized by the synthesizing means 15.

Figure 2:
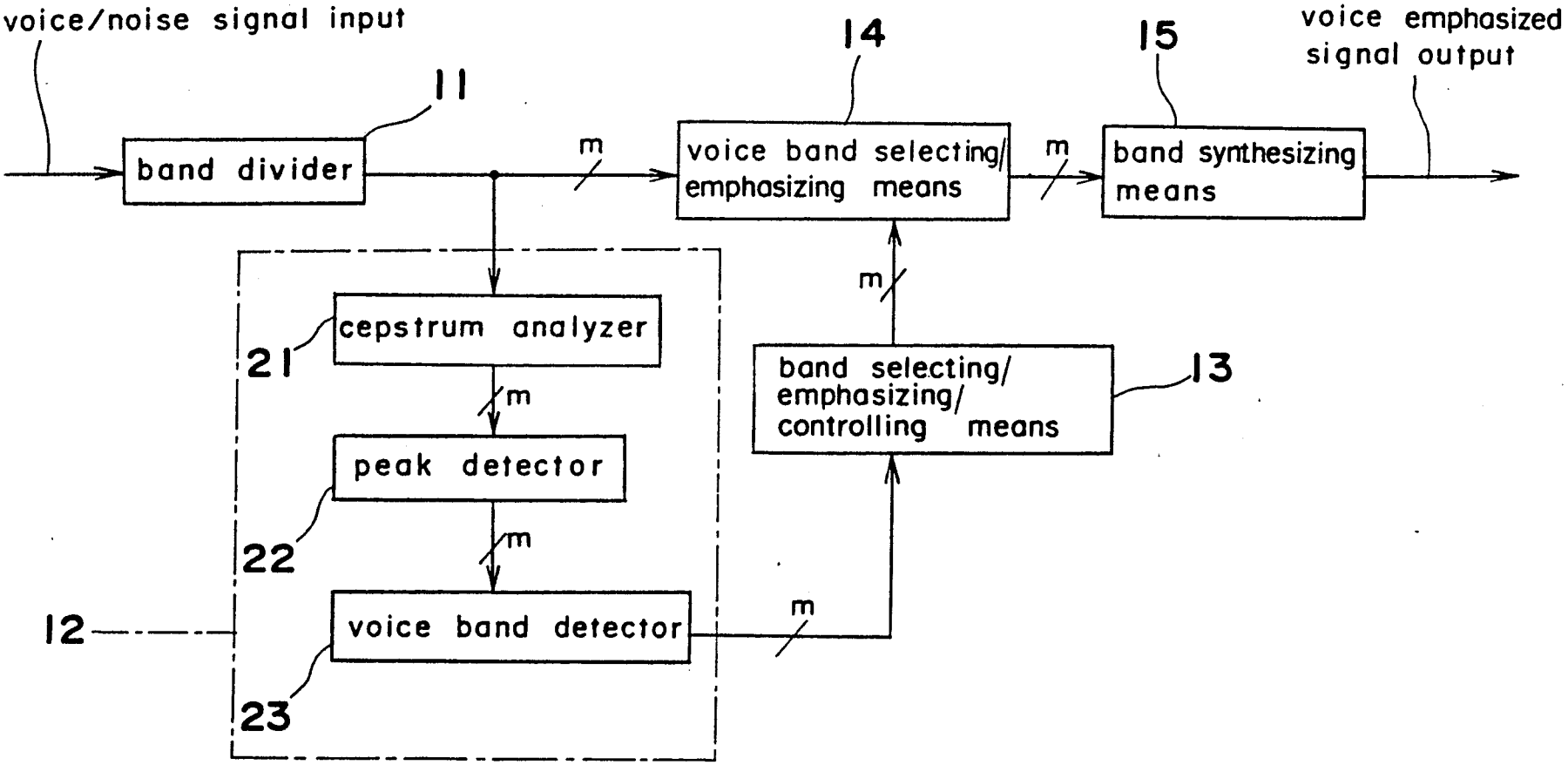
FIG. 2 is a block diagram more in detail of the voice signal processor of FIG. 1.
Figure 20A:
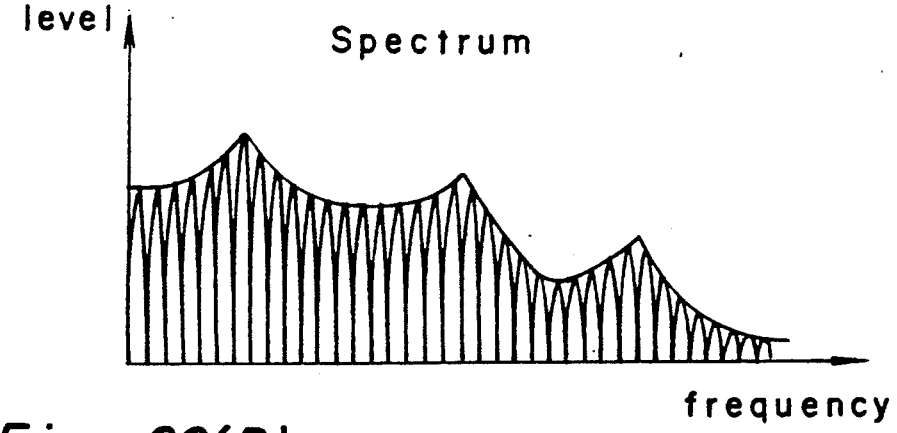
FIGS. 20(A) and 20(B) are graphs explanatory of the Cepstrum analysis employed in the voice signal processor.
Figure 20B:
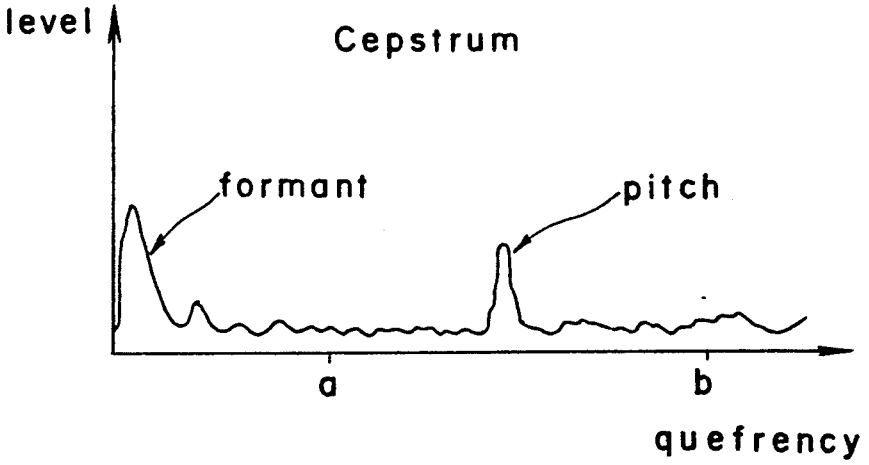

FIG. 2 is a block diagram of a modified voice signal processor of FIG. 1. Specifically, the voice band detecting means 12 is provided with a Cepstrum analyzing means 21, a peak detecting means 22 and a voice band detecting circuit 23. The Cepstrum analyzing means 21 subjects the Fourier-transformed signal by the dividing means 11 to a Cepstrum analysis. The Cepstrum is an inverse Fourier transformation of a logarithm of a short-term amplitude spectrum of a waveform. FIG. 20(A) is a graph of the short-term spectrum, and FIG. 20(B) is its Cepstrum. The peak detecting means 22 discriminates the voice signal from noise through the detection of a peak(pitch) of the Cepstrum obtained by the Cepstrum analyzing means 21. The position where the peak is present is judged as a voice signal portion. The peak can be detected, for example, through comparison with a preset threshold value of a predetermined size. Moreover, the voice band detecting circuit 23 obtains a quefrency value of the peak detected by the peak detecting means 22 from FIG. 20(B). The voice band is thus detected. The other parts of the voice signal processor are the same as in the embodiment of FIG. 1, and therefore the description thereof has been omitted here.

Figure 3:
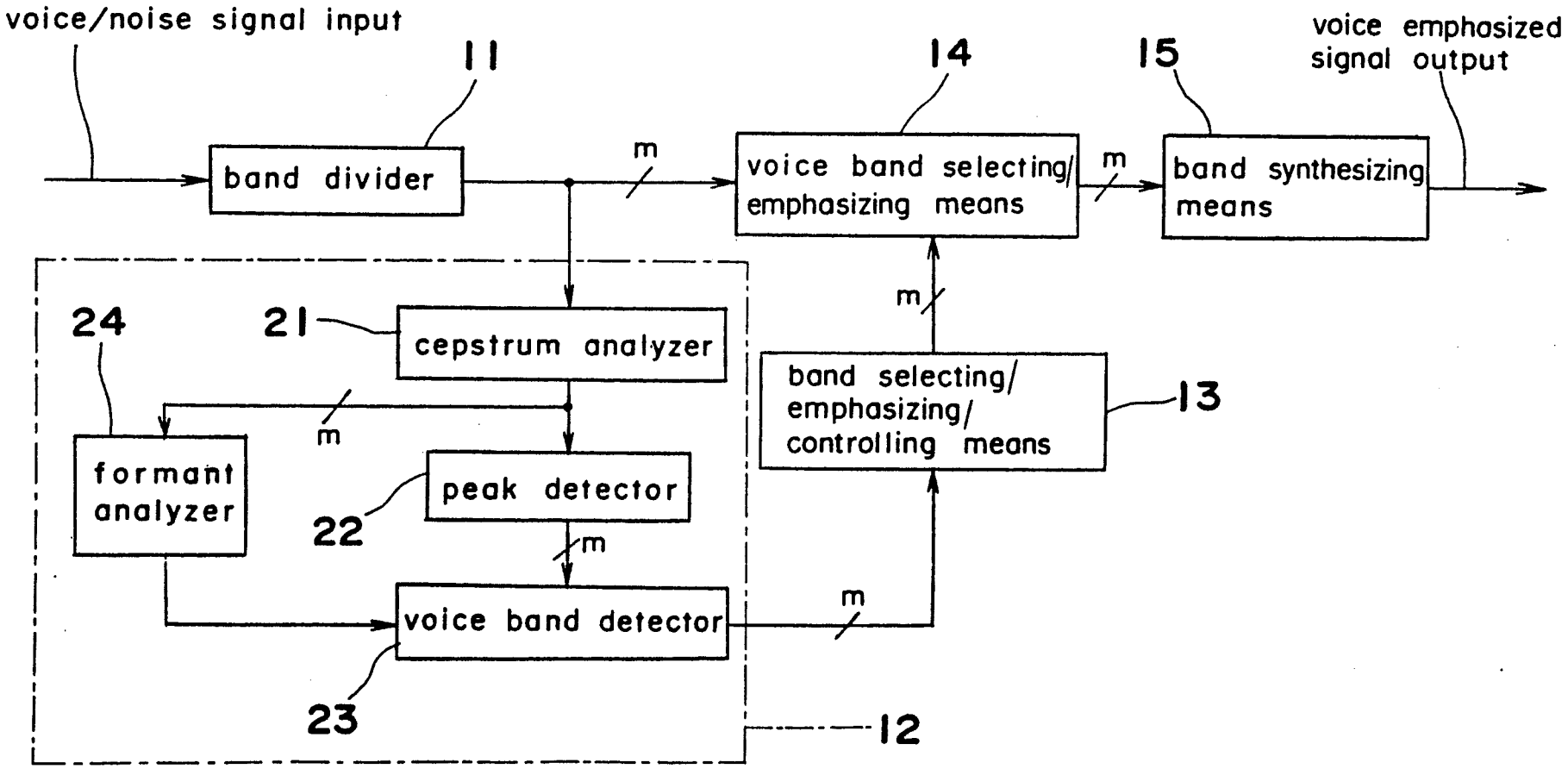
FIG. 3 is a block diagram of a modification of the voice signal processor of FIG. 2.

FIG. 3 is a block diagram of a further modification of the voice signal processor of FIG. 1, particularly, the voice band detecting means 12. The voice band detecting means 12 in FIG. 3 is provided with a formant analyzing means 24 in addition to the Cepstrum analyzing means 21, a peak detecting means 22 and a voice band detecting circuit 23. This formant analyzing means 24 analyzes the formant in the result of the Cepstrum analysis of the analyzing means 21 (with reference to FIG. 20(B)). The voice band detecting circuit 23 detects a voice band by utilizing both the peak information obtained by the peak detecting means 22 and the formant information obtained by the analyzing means 24. In this modified embodiment, since both the formant information and the peak information are utilized to detect the voice band, it enables a more accurate detection of the voice band. Since the other parts are identical to those in FIG. 2, the detailed description thereof has been omitted.

Figure 4:
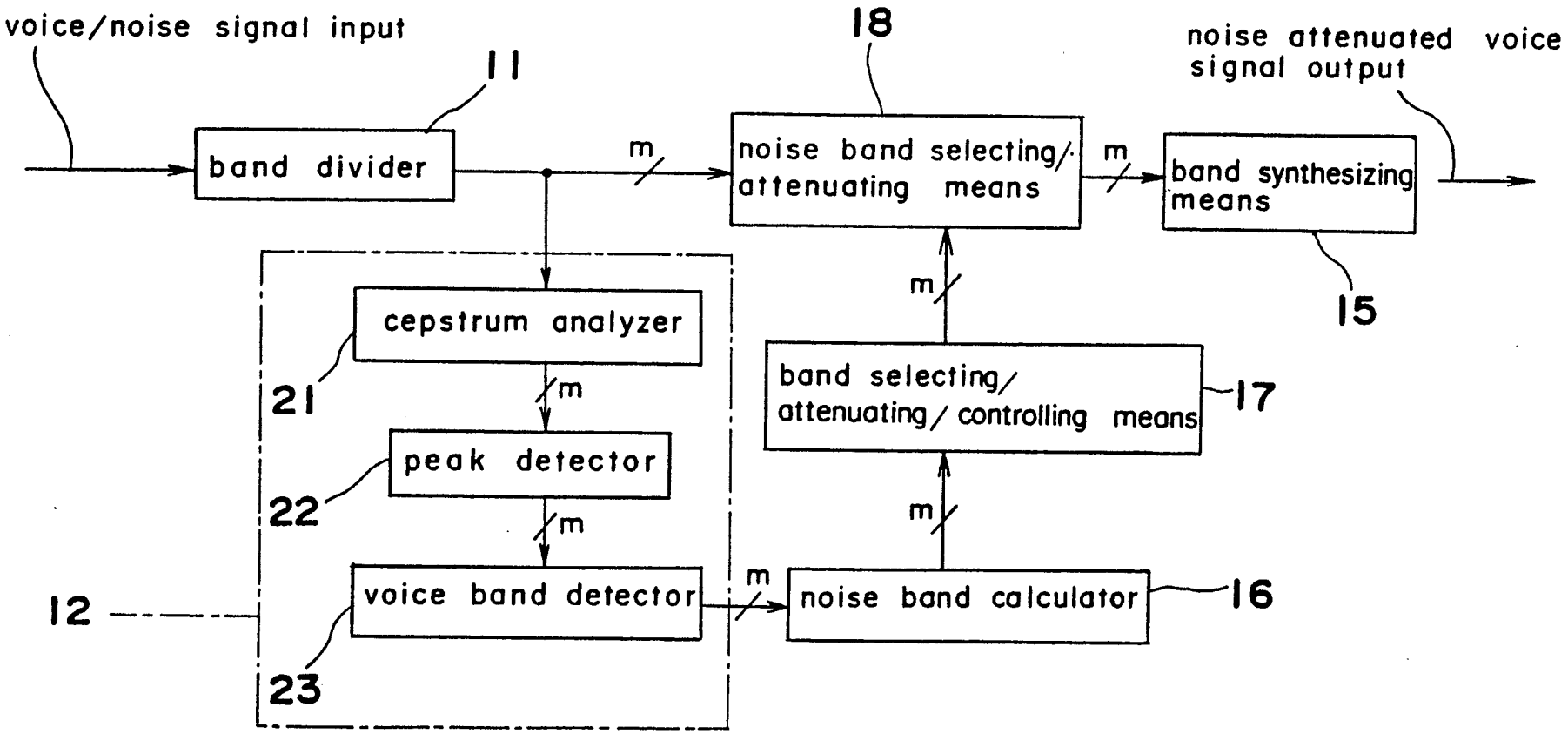
FIG. 4 is a block diagram of a modification of the voice signal processor of FIG. 2.

FIG. 4 is a block diagram of a modification of the voice signal processor of FIG. 2, which is arranged to attenuate the noise level of the noise band.

The band dividing means 11, Cepstrum analyzing means 21, peak detecting means 22 and voice band detecting circuit 23 are the same as in the embodiment of FIG. 2, so that the description thereof will be abbreviated here.

An output of the voice band detecting circuit 23 is input to a noise band calculating means 16 which in turn calculates the noise band on the basis of the voice band information detected by the circuit 23, for example, it discriminates a band from which the voice band is removed as a noise band. A band selecting/attenuating/controlling means 17 outputs an attenuation control signal on the basis of the noise band information obtained by the calculating means 16. A noise band selecting/attenuating means 18 attenuates the signal level in the noise band from the signal fed from the dividing means 11 in accordance with the control signal from the control means 17. Accordingly, the signal in the voice band is relatively emphasized. The band synthesizing means 15 synthesizes the signal attenuated in the signal level in the noise band. According to the embodiment of FIG. 4, the signal level in the noise band is attenuated, eventually resulting in a relative emphasis of the voice band, thus improving the S/N ratio.

Figure 5:
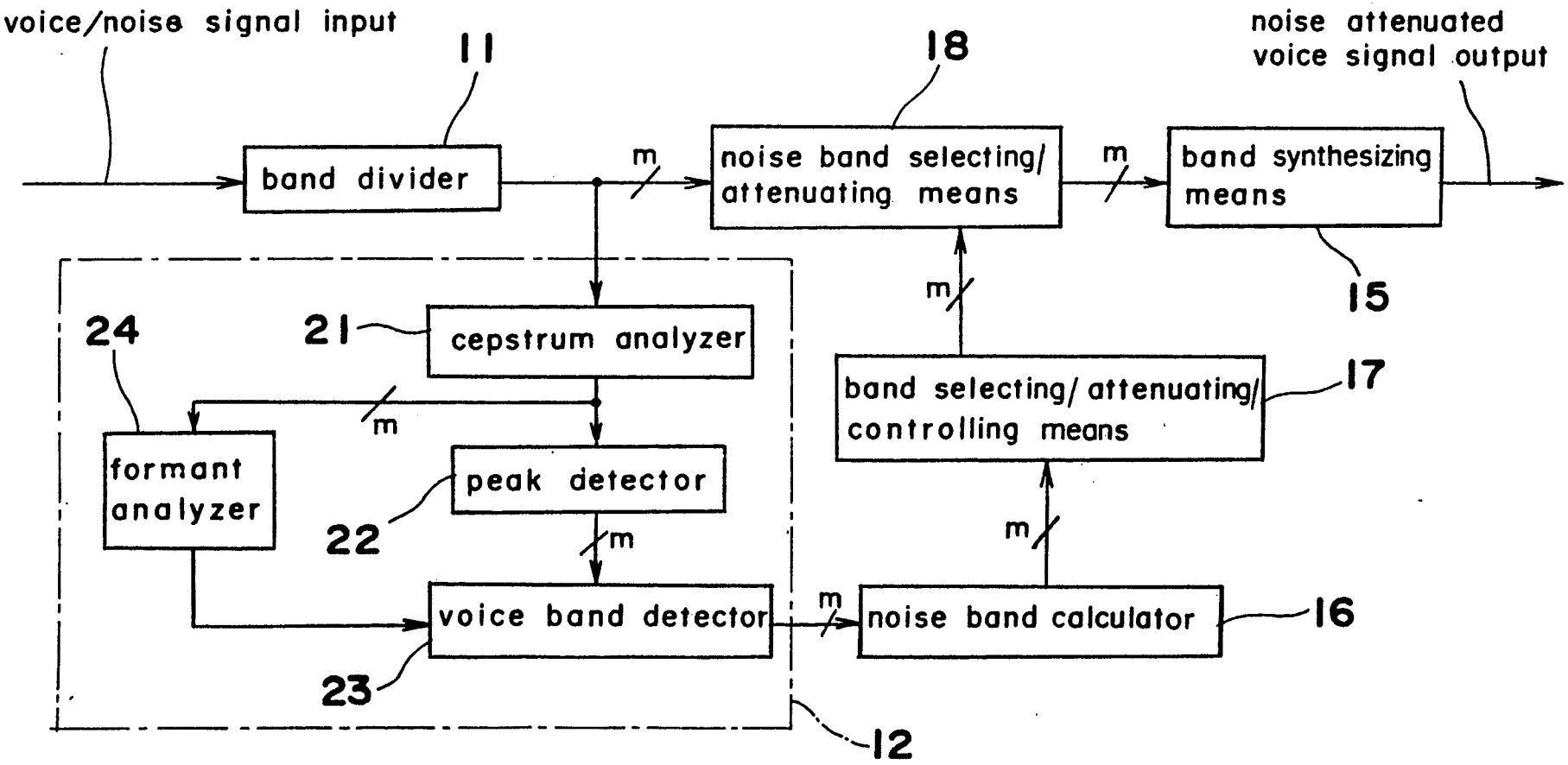
FIG. 5 is a block diagram of a modification of the voice signal processor of FIG. 4.

In FIG. 5, the formant analyzing means 24 is added to the apparatus of FIG. 4. According to this modification, the voice band is detected more precisely because of the formant analysis, thus enabling the noise band calculating means to detect the noise band more accurately.

Figure 6:
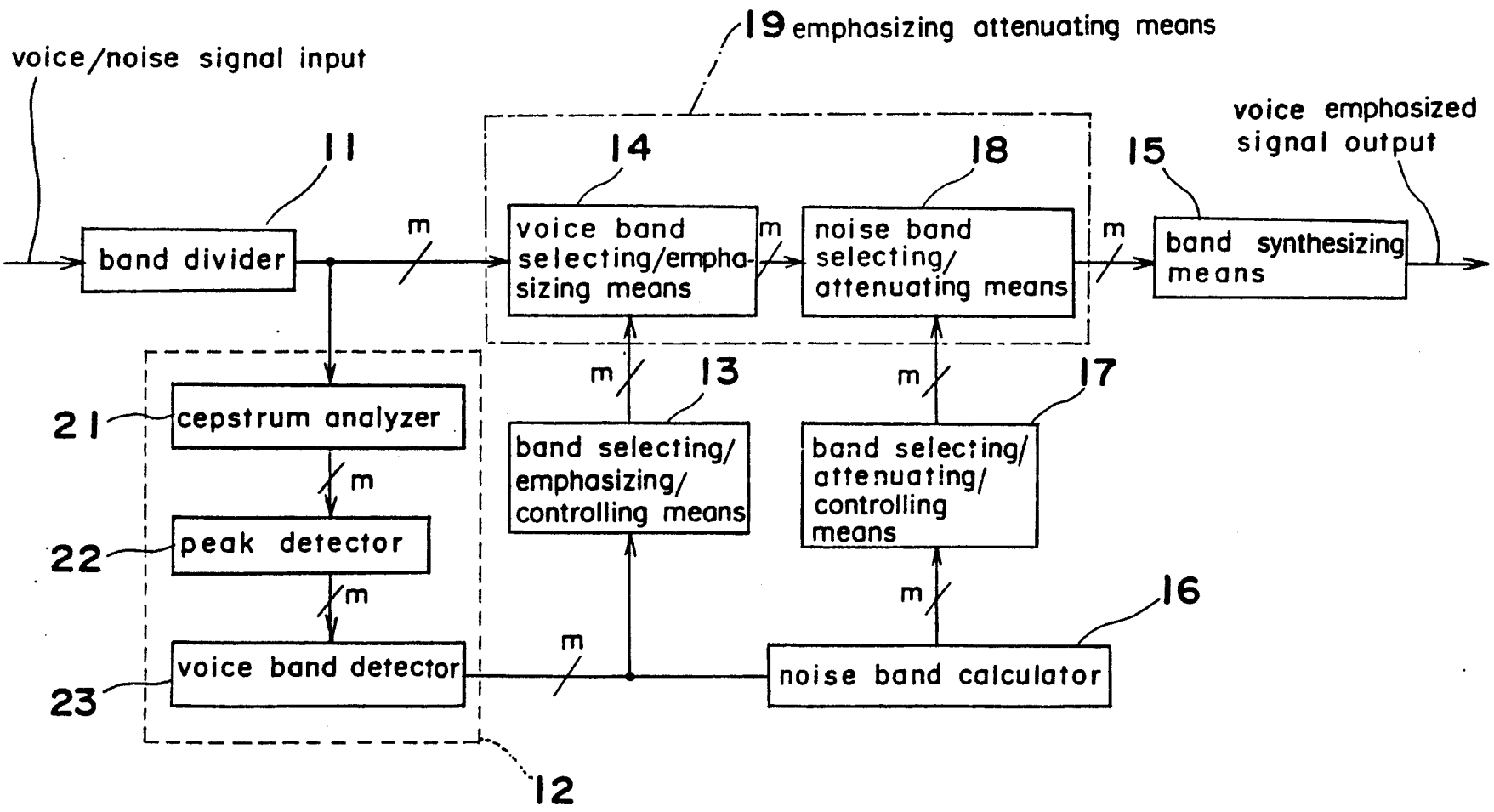
FIG. 6 is a block diagram of a voice signal processor in combination of FIGS. 2 and 4.

FIG. 6 is a combination of FIGS. 2 and 4. In other words, the band dividing means 11, Cepstrum analyzing means 21, peak detecting means 22 and voice band detecting circuit 23 are provided in common. An output of the voice band detecting circuit 23 is input to both the voice band selecting/emphasizing/controlling means 13 and noise band calculating means 16. An output of the controlling means 13 is input to the voice band selecting/emphasizing means 14 which amplifies the signal level of the divided signal output from the dividing means 11 only in the voice band. On the other hand, the noise band calculated by the noise band calculating means 16 is input to the band selecting/attenuating/controlling means 17 which subsequently generates a control signal to the noise band selecting/attenuating means 18. The noise band selecting/attenuating means 18 attenuates the signal level of the signal supplied from the voice band selecting/emphasizing means 14 only in the noise band. It may be possible to attenuate the signal level in the noise band by the attenuating means 18 prior to the amplification of the signal level in the voice band by the emphasizing means 14. The voice band selecting/emphasizing means 14 and noise band selecting/attenuating means 18 constitute an emphasizing/attenuating means 19. In this embodiment, the voice level of the voice band is amplified concurrently when the noise level in the noise band is attenuated. Therefore, the S/N ratio is furthermore improved.

Figure 7:
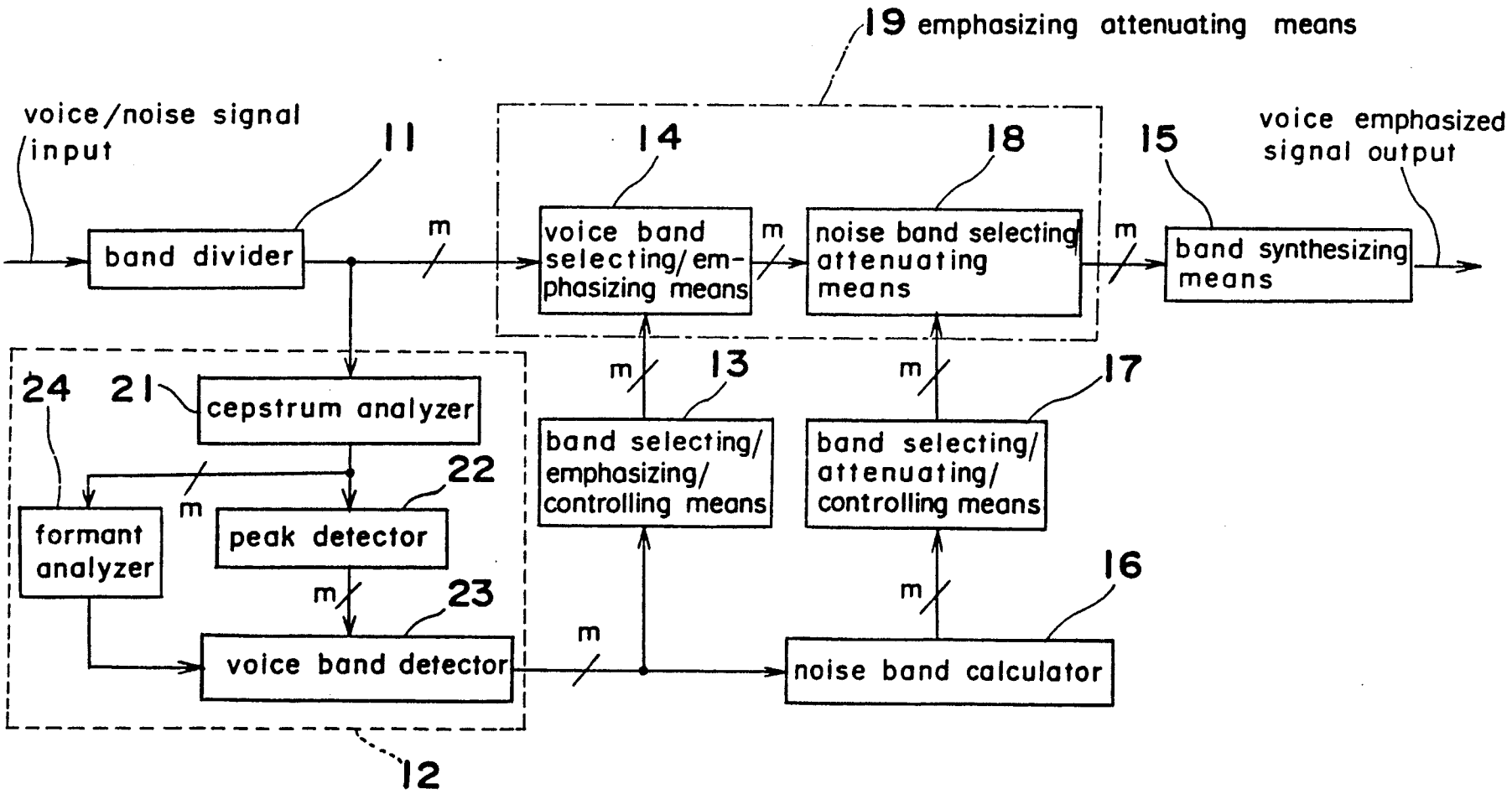
FIG. 7 is a block diagram of a modification of the voice signal processor of FIG. 6.

FIG. 7 is a block diagram of a modification of FIG. 6 wherein the formant analyzing means 24 is added. The operation and other parts than the formant analyzing means 24 are quite the same as in the embodiment of FIG. 6, with the description thereof being abbreviated. An addition of the formant analyzing means 24 ensures high-precision detection of the voice band.

In the foregoing embodiments described so far, although the function of the voice band detecting means, voice band selecting/emphasizing means, etc. can be implemented in the software of a computer, it may be realized by the use of a special hardware having respective functions.

As is clear from the above description, in the voice signal processor according to the first embodiment of the present invention, the voice signal mixed with noise is divided into frequency bands, and the signal level in the voice band is emphasized relatively to the signal level in the noise band, thereby remarkably improving the S/N ratio.

Figure 8:
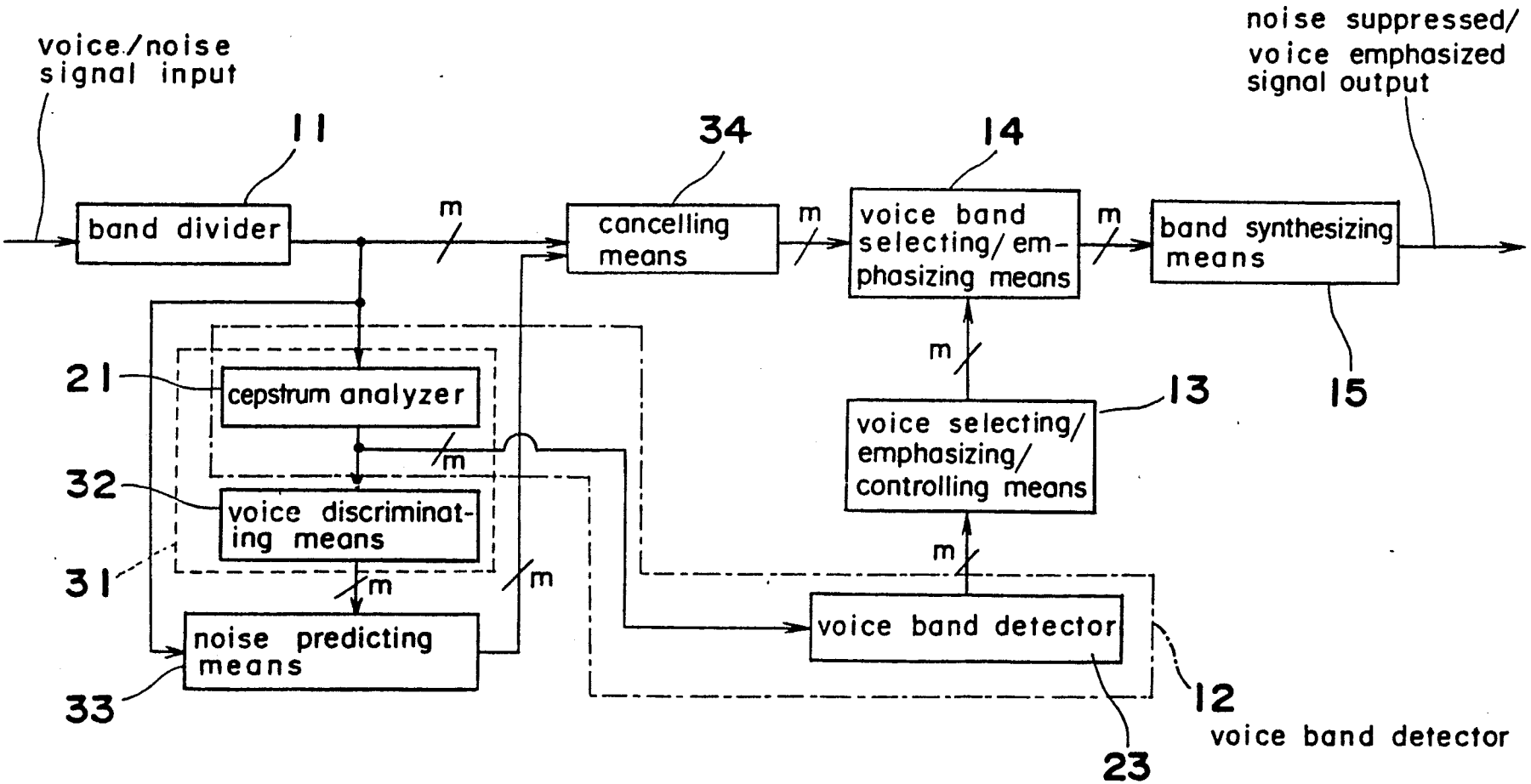
FIG. 8 is a block diagram of a voice signal processor according to a second embodiment of the present invention.

FIG. 8 is a block diagram showing the structure of a voice signal processor according to a second embodiment of the present invention.

Referring to FIG. 8, a band dividing means 11 receives, A/D converts and Fourier-transforms a signal which is a mixture of voice and noise.

A voice band detecting means 12 receives the mixed signal including noise from the dividing means 11 and detects the frequency band of a voice signal portion in the mixed signal. For example, the voice band detecting means 12 has a Cepstrum analyzing means 21 for performing Cepstrum analysis and a voice band detecting circuit 23 for detecting the voice band using the result of the Cepstrum analysis. The relationship of the voice band and noise band from a viewpoint of frequency is generally identified as shown in a graph of FIG. 21, wherein S represents the voice signal band, and N indicates the noise band. The voice band detecting circuit 23 detects the band S.

A band selecting/emphasizing/controlling means 13 outputs a control signal for emphasizing the voice band on the basis of the voice band information detected by the voice band detecting circuit 23.

A voice discriminating means 31 discriminates a voice portion in the voice signal mixed with noise supplied from the band dividing means 11, which is provided with, e.g., the Cepstrum analyzing means 21 for performing Cepstrum analysis referred to earlier and a voice discriminating circuit 32 for discriminating a voice using the result of the Cepstrum analysis.

Figure 22:
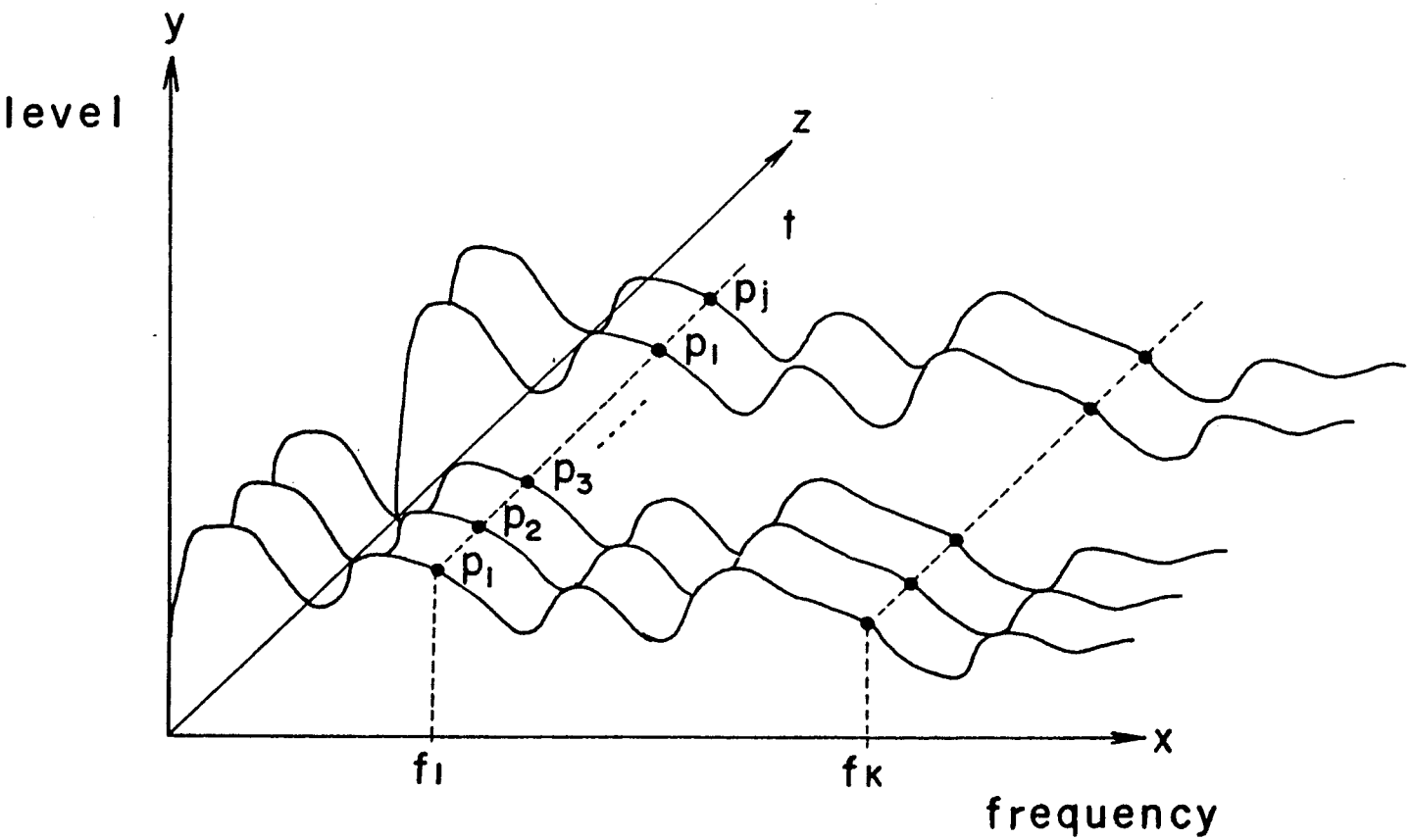
FIG. 22 is a graph explanatory of the noise estimation employed in the present invention.
Figures 23A, 23B, 23C, 23D, 23E, 23F:
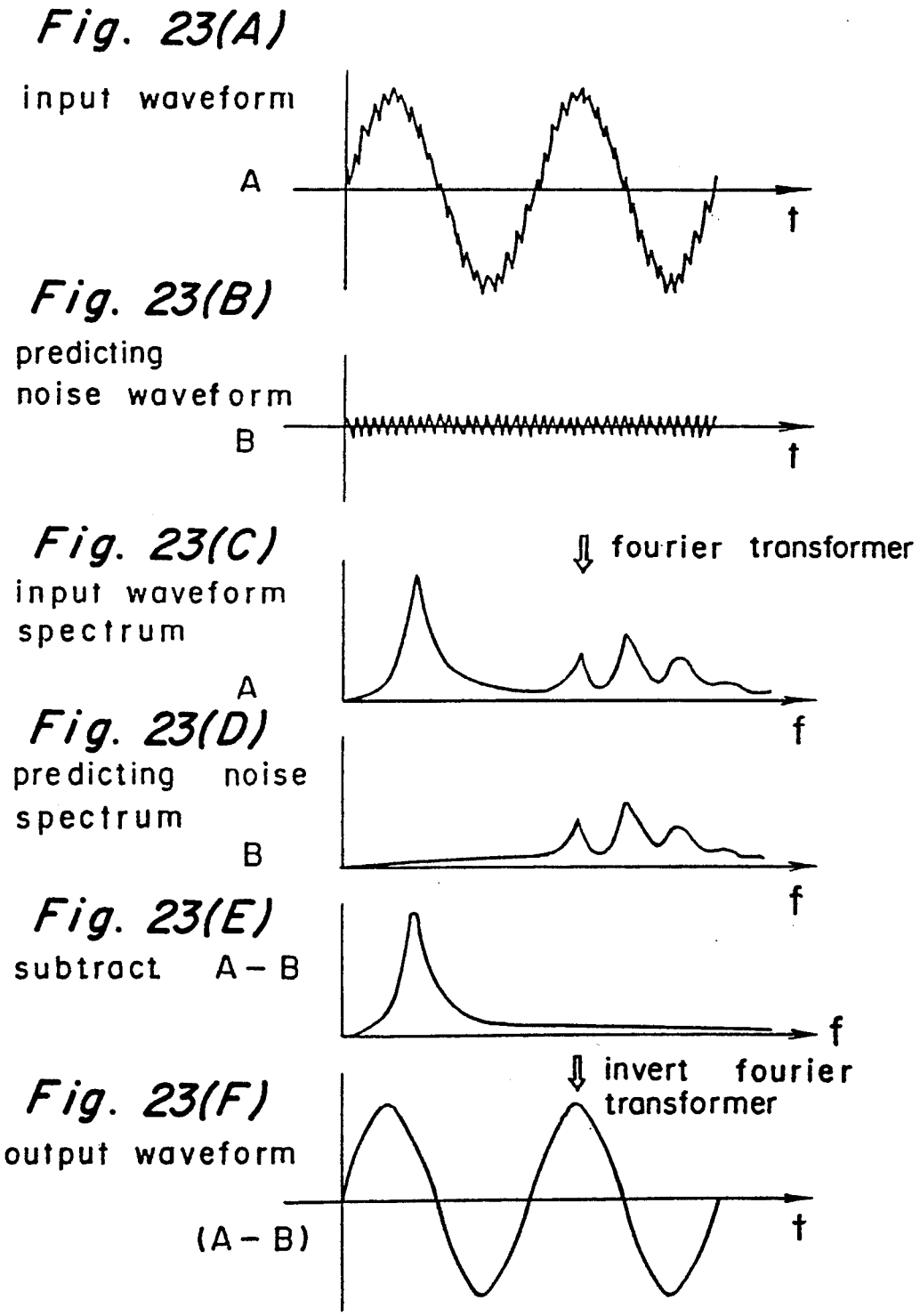
FIGS. 23(A)–23(F) are graphs explanatory of the noise cancellation employed in the present invention.

A noise predicting means 33 obtains a noise portion from the voice portion detected by the discriminating means 31 so as to thereby predict the noise of the voice portion on the basis of the noise information of only the noise portion. This noise predicting means 33 predicts the noise portion for every channel for the mixed signal divided into m channels. As indicated in FIG. 22, for example, supposing that a frequency is indicated on an X axis, a voice level on a y axis and time on a z axis, respectively, pj is predicted from the data p1,p2, . . . , pi when the frequency is f1, e.g., an average of the noise portions p1–pi is rendered pj. If the voice signal portions continue, an attenuation factor is multiplied with pj.

Cancelling means 34 to which is supplied a signal of m channels from the band dividing means 11 and noise predicting means 33 subtracts noise from the signal for every channel so as to thereby execute noise cancellation. The cancellation is carried out in the order as shown in FIGS. 23(A)–23(F). Specifically, a voice signal mixed with noise (FIG. 23(A)) is Fourier-transformed (FIG. 23(C)), from which a spectrum of an predicted noise (FIG. 23(D)) is subtracted (FIG. 23(E)), and inversely Fourier-transformed (FIG. 23(F)), so that a voice signal without noise is obtained.

When the voice signal mixed with noise from which noise is removed by the cancelling means 34 is input to the voice band selecting/emphasizing means 14, the emphasizing means 14 selects so as to emphasize the voice band in accordance with a control signal from the controlling means 13.

The emphasized signal from the emphasizing means 14 is synthesized by the band synthesizing means 15, for example, through an inverse Fourier-transformation.

The operation of the voice signal processor of this embodiment in FIG. 8 will now be described.

The voice signal mixed with noise is divided by the band dividing means 11. The voice band of the signal divided by the dividing means 11 is detected by the detecting means 12. Then, the band selecting/emphasizing/controlling means 13 outputs a control signal based on the voice band information from the detecting means 12.

In the meantime, the voice discriminating means 31 predicts noise in the voice signal portion among the voice signal mixed with noise. A predicted noise value of the discriminating means 31 is removed from the voice signal mixed with noise by the cancelling means 34. The voice band selecting/emphasizing means 14 emphasizes the voice level of the signal in the voice band from which some noise is removed in accordance with the control signal of the controlling means 13.

After the voice level of the voice signal mixed with noise is emphasized by the emphasizing means 14, the signal is synthesized by the band synthesizing means 15.

Figure 9:
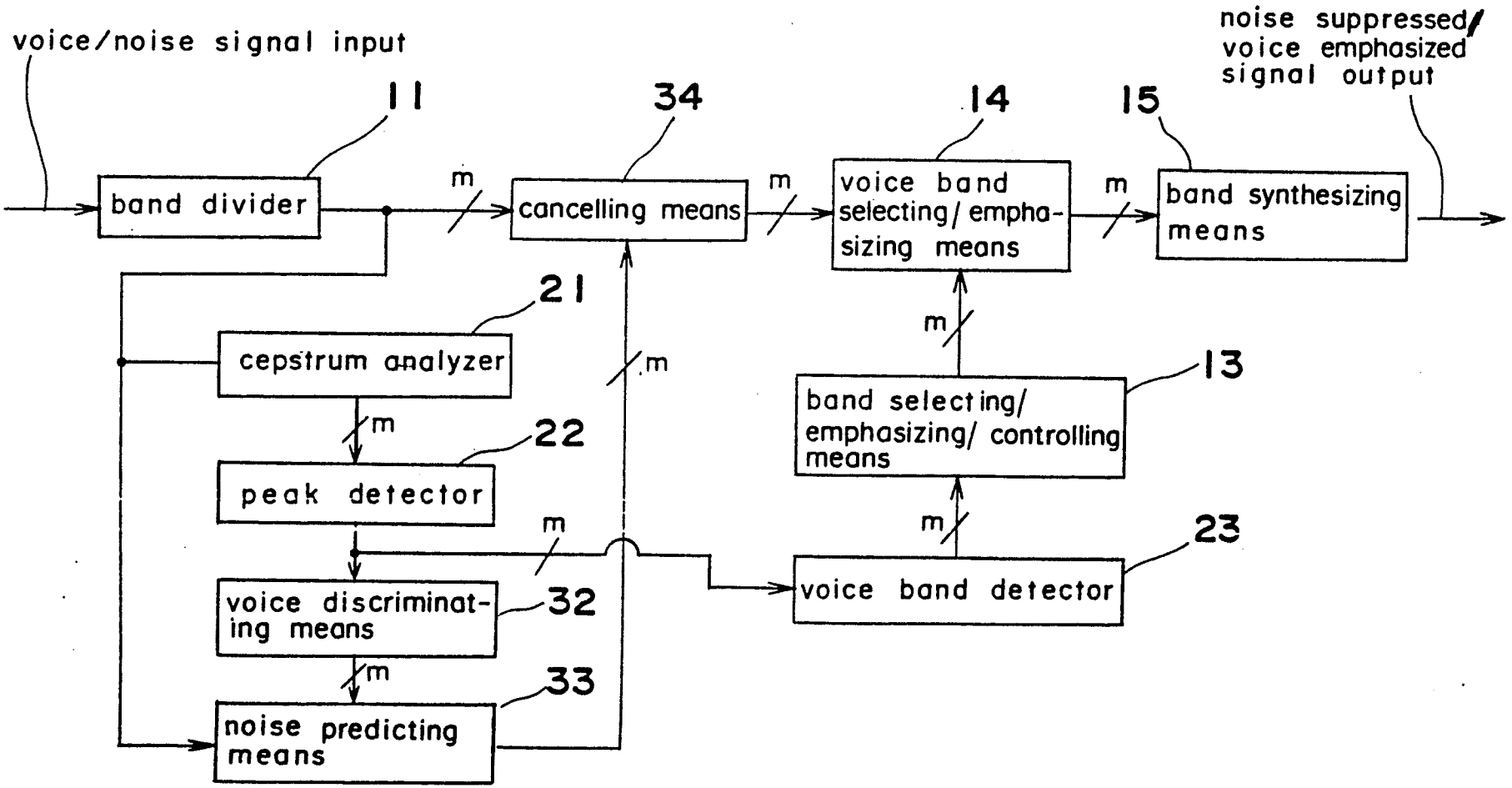
FIG. 9 is a block diagram more in detail of the voice signal processor of FIG. 8.

FIG. 9 is a block diagram of a modification of FIG. 8. More specifically, the Cepstrum analyzing means 21 is indicated in more concrete structure. The Cepstrum analyzing means 21 performs Cepstrum analysis to the signal Fourier-transformed by the dividing means 11. The Cepstrum is an inverse Fourier-transformation of a logarithm of a short-term amplitude spectrum of a waveform as indicated in FIGS. 20(A) and 20(B) FIG. 20(A) illustrates a short-term spectrum and FIG. 20(B) shows the Cepstrum thereof. The peak detecting means 22 detects a peak(pitch) of the Cepstrum obtained by the Cepstrum analyzing means 21 so as to thereby to distinguish the voice signal from the noise signal. The portion where the peak is present is detected as a voice signal portion. The peak is detected, for example, by comparing the Cepstrum with a predetermined threshold value set beforehand. A voice band detecting circuit 23 obtains a quefrency value of the peak detected by the peak detecting means 22 with reference to FIG. 20(B). Accordingly, the voice band is detected. A voice discriminating circuit 32 discriminates the voice signal portion from the peak detected by the peak detecting means 22. Since the other parts are constructed and driven in the same fashion as in the embodiment of FIG. 8, the detailed description thereof has been omitted here.

Figure 10:
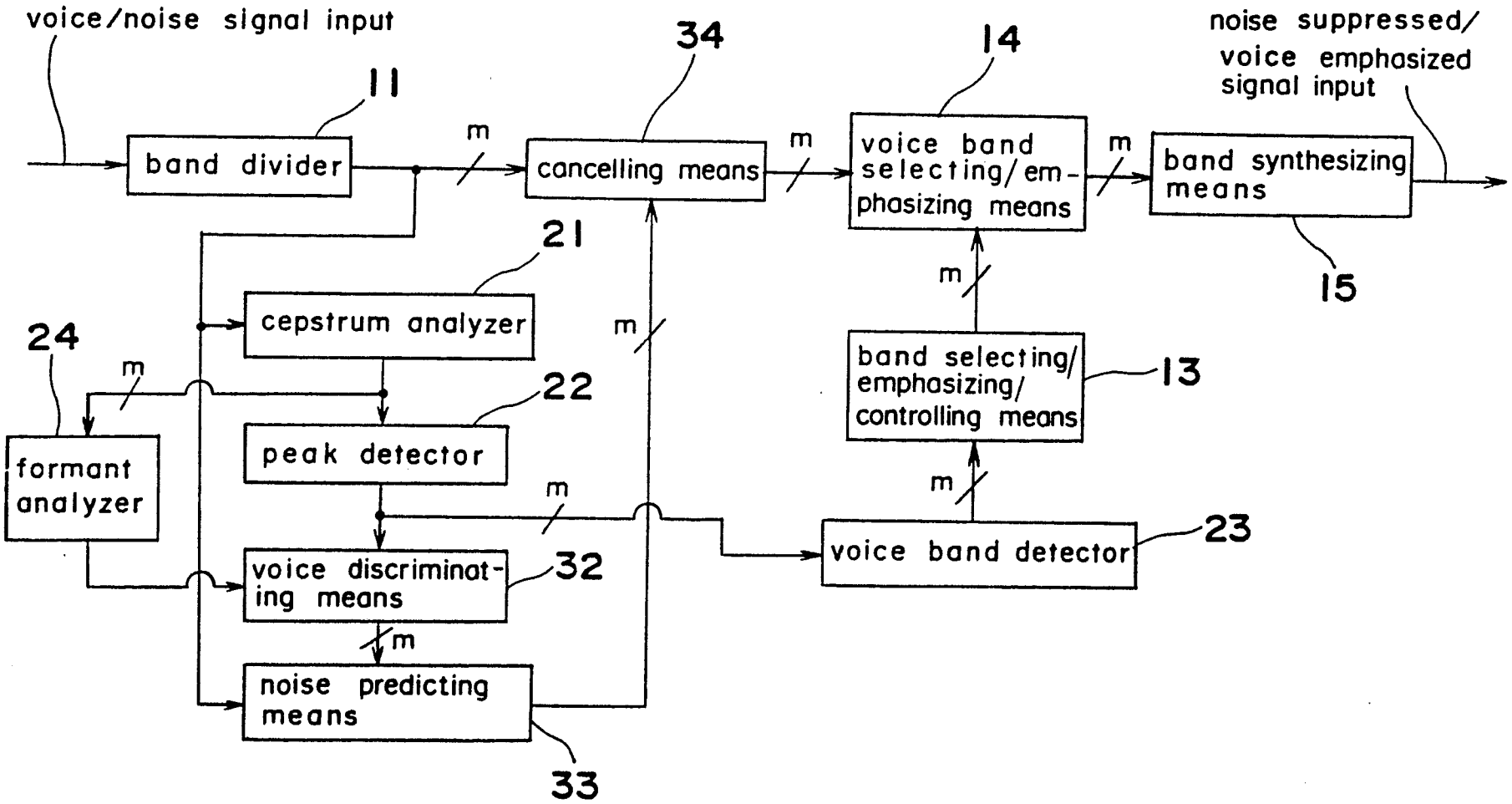
FIG. 10 is a block diagram of a modification of the voice signal processor of FIG. 9.

FIG. 10 is a block diagram of a modification of FIG. 9, in which a formant analyzing means 24 is provided. The formant analyzing means 24 analyzes the formant the result of the Cepstrum analysis of the analyzing means 21 (referring to FIG. 20(B)). A voice band detecting circuit 23 detects a voice band by utilizing the peak information of the peak detecting means 22 and the formant information analyzed by the formant analyzing means 24. According to the embodiment of FIG. 10, both the peak information and the formant information are utilized to detect the voice band. As a result, the voice band can be detected more precisely. The other parts of the processor in FIG. 10 are the same as those in FIG. 9, with the description thereof being omitted.

Figure 11:
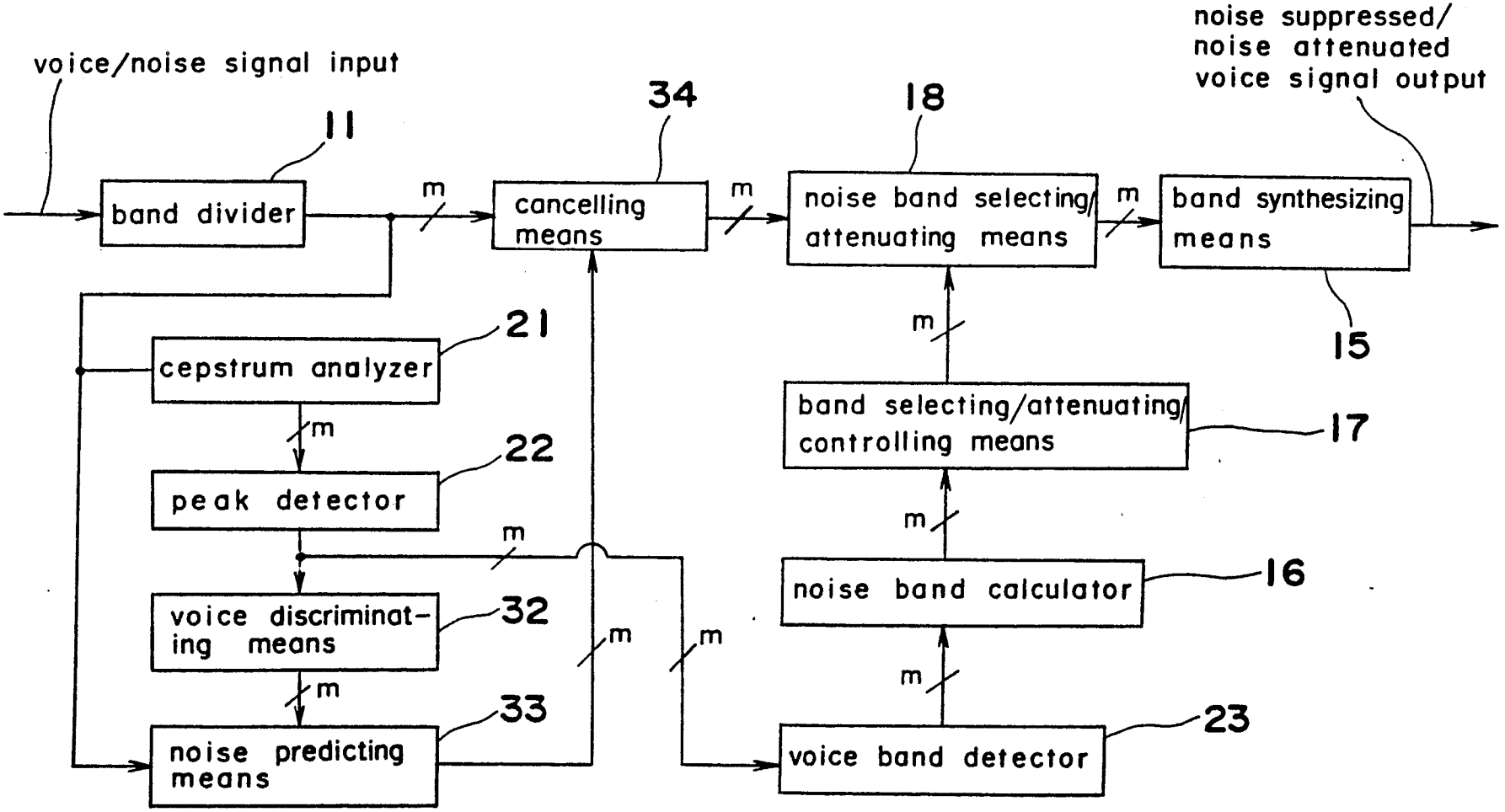
FIG. 11 is a block diagram of a modification of the voice signal processor of FIG. 9.

FIG. 11 shows a block diagram of a modification of the voice signal processor of FIG. 9. In the voice signal processor of FIG. 11, the noise band is calculated, so that the noise level in the noise band is attenuated.

The band detecting means 11, Cepstrum analyzing means 21, peak detecting means 22 and voice band detecting circuit 23 are identical to those in the embodiment of FIG. 9, and therefore the description thereof has been omitted.

An output of the voice band detecting circuit 23 is input to a noise band calculating means 16. The noise band calculating means 16 calculates a noise band on the basis of the voice band information from the circuit 23, e.g., by discriminating a band from which the voice band is removed as a noise band. A band selecting/attenuating/controlling means 17 outputs, based on the noise band information calculated by the noise band calculating means 16, an attenuation control signal. A noise band selecting/attenuating means 18 attenuates the signal level in the noise band among the signal sent from a cancelling means 34 in accordance with the control signal from the controlling means 17. Consequently, the signal in the voice band is relatively emphasized. A band synthesizing means 15 synthesizes the attenuated signal in the noise band. As described above, the signal level in the noise band is attenuated according to this embodiment, and accordingly the voice band is relatively emphasized, with the S/N ratio improved.

Figure 12:
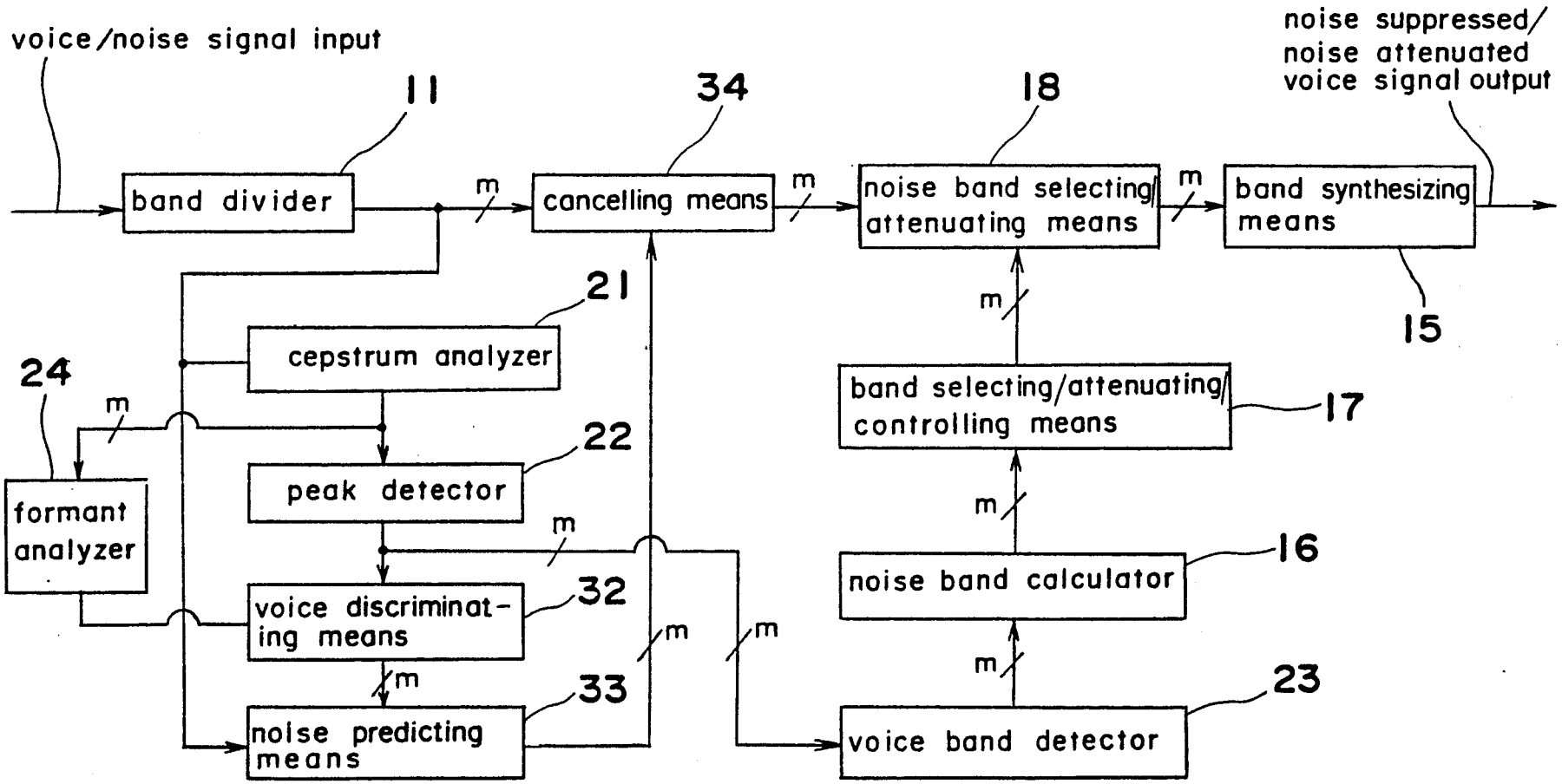
FIG. 12 is a block diagram of a modification of the voice signal processor of FIG. 11.

FIG. 12 is a modification of FIG. 11. There formant analyzing means 24 is added to the apparatus of FIG. 11. According to this embodiment as well, the voice band can be detected more precisely because of the formant analysis, allowing the noise band calculating means 16 to detect the noise band more precisely.

Figure 13:
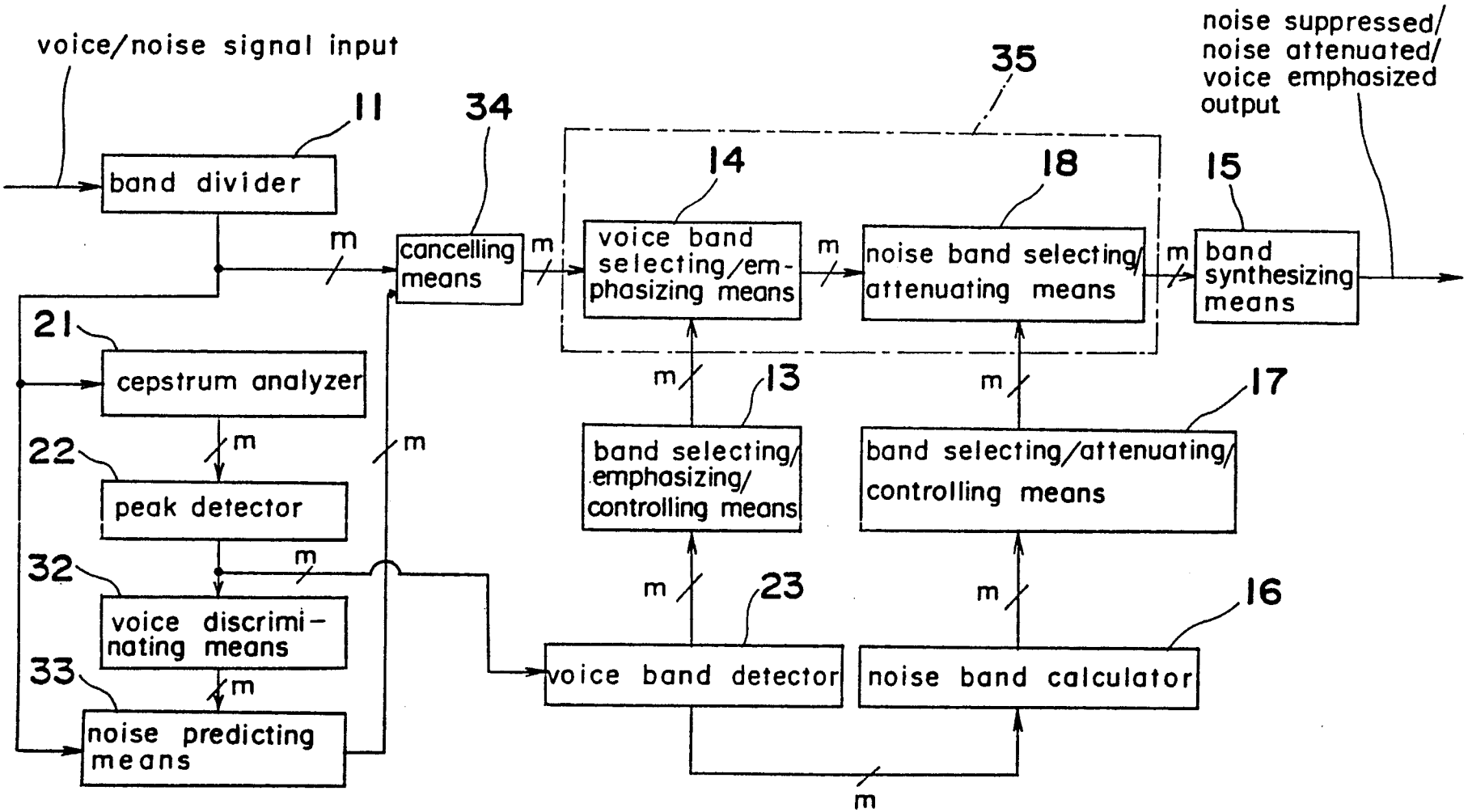
FIG. 13 is a block diagram of a voice signal processor in combination of FIGS. 9 and 11.

FIG. 13 is a block diagram of a combined embodiment of FIGS. 9 and 11. In other words, the band dividing means 11, Cepstrum analyzing means 21, peak detecting means 22, voice discriminating circuit 32 and voice band detecting circuit 23 are provided in common to the apparatuses of FIGS. 9, 11 and 13. An output of the voice band detecting circuit 23 is input to the band selecting/emphasizing/controlling means 13 and noise band calculating means 16. An output of the controlling means 13 is input to the voice band selecting/emphasizing means 14 which emphasizes the signal level only in the voice band of the signal sent from the cancelling means 34. On the other hand, the noise band calculated by the noise band calculating means 16 is input to the band selecting/attenuating/controlling means 17, and the band selecting/attenuating/controlling means 17 outputs a control signal. The signal level only in the noise band of the output from the voice band selecting-/emphasizing means 14 is attenuated by the noise band selecting/attenuating means 18. The signal level in the noise band may be attenuated first, and the signal level in the voice band may be amplified thereafter. The voice band selecting/emphasizing means 18 constitute an emphasizing/attenuating means 35. According to this embodiment shown in FIG. 13, the voice level in the voice band is amplified, and at the same time, the noise level in the noise band is attenuated, thereby improving the S/N ratio much more.

Figure 14:
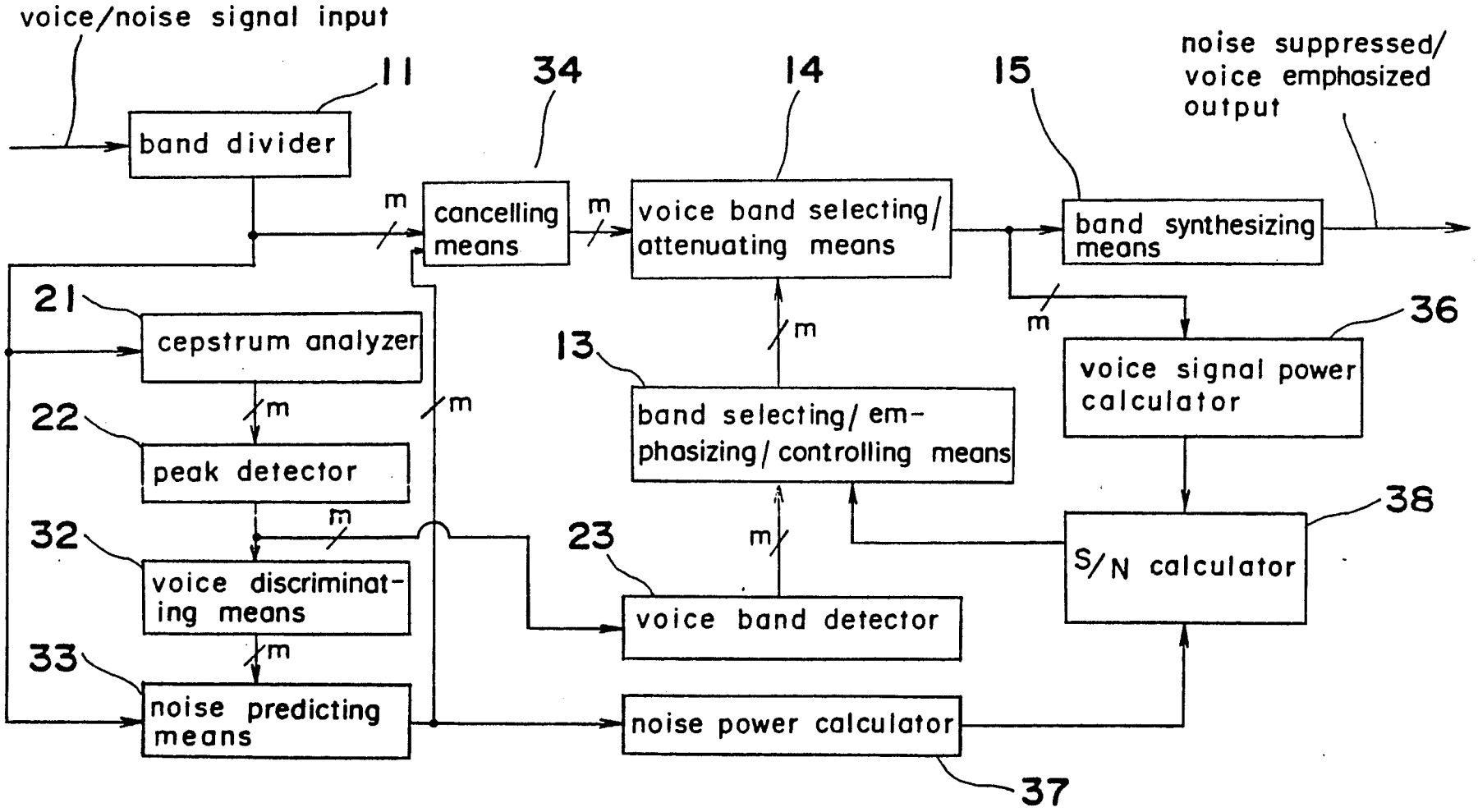
FIG. 14 is a block diagram of a modification of the voice signal processor of FIG. 9.

In a voice signal processor of FIG. 14, the band selecting/emphasizing/controlling means 13 shown in FIG. 9 is restricted in some point, with an intention to achieve an appropriate improvement of the S/N ratio.

That is, on the basis of an output from the noise predicting means 33, a noise power calculating means 37 calculates the size of the noise. Meanwhile, a voice signal power calculating means 36 calculates the size of the emphasized voice signal from the emphasizing means 14. An S/N ratio calculating means 38 to which are input the voice signal calculated by the calculating means 36 and the noise power calculated by the calculating means 37 calculates the S/N ratio. The band selecting/emphasizing/controlling means 13 generates a control signal to the voice band selecting/emphasizing means 14 so that the S/N ratio input thereto from the calculating means 38 becomes a desired target value for the S/N ratio. The target value is, for example, 1/15. The target value means to prevent the voice signal from being emphasized too much with respect to the noise.

Figure 15:
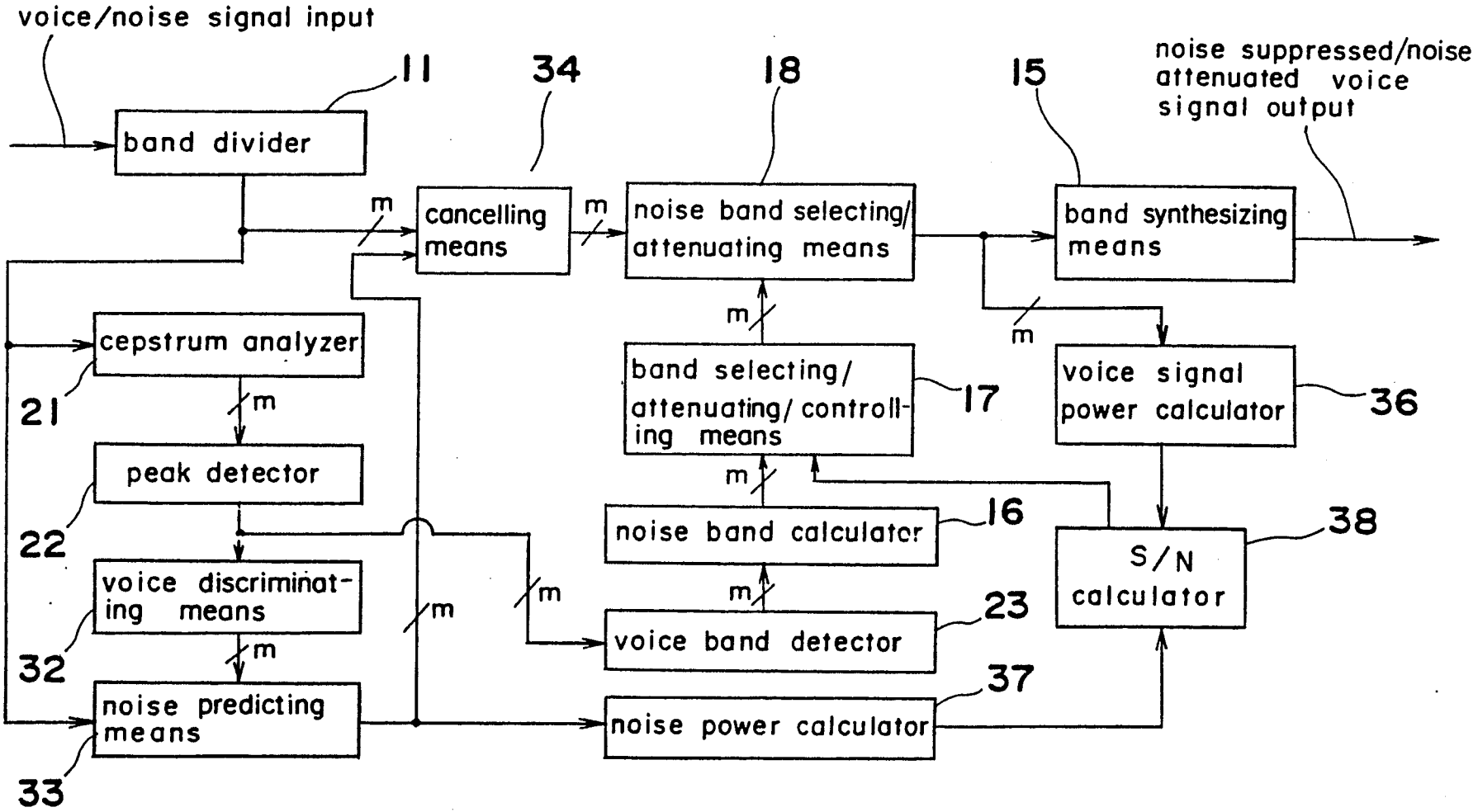
FIG. 15 is a block diagram of a modification of the voice signal processor of FIG. 11.

FIG. 15 is a modification of FIG. 11 with some restriction added to the band selecting/attenuating/controlling means 17 to achieve an appropriate improvement of the S/N ratio.

As described above with to FIG. 14, the noise power calculating means 37 calculates the size of the noise based on the output from the noise predicting means 33. The voice signal power calculating means 36 calculates the size of the voice signal after the voice signal is relatively emphasized to the noise as a result of the attenuation of noise by the attenuating means 18. The S/N ratio calculating means 38 receives the voice signal calculated by the calculating means 36 and the noise power obtained by the calculating means 37 so as to thereby calculate the S/N ratio. The S/N ratio calculated by the calculating means 38 is input to the band selecting/attenuating/controlling mean 17. The controlling means 17 outputs a control signal to the noise band selecting-/attenuating means 18 or to the voice band selecting-/emphasizing means 14 so that the input S/N ratio becomes a predetermined target S/N value.

In the foregoing embodiments in FIGS. 8–15, the voice band detecting means, voice band selecting/emphasizing means, etc. can be realized the software of a computer, but it may also be possible to use special hardware for respective functions.

As is understood from the foregoing embodiments, according to the present invention, the voice signal mixed with noise is divided into frequency bands, and the predicted noise is cancelled from the divided signal. The voice level in the voice band of the signal after the noise thereof is cancelled is emphasized relative to the signal level in the noise band. Accordingly, the S/N ratio can be remarkably improved.

Figure 16:
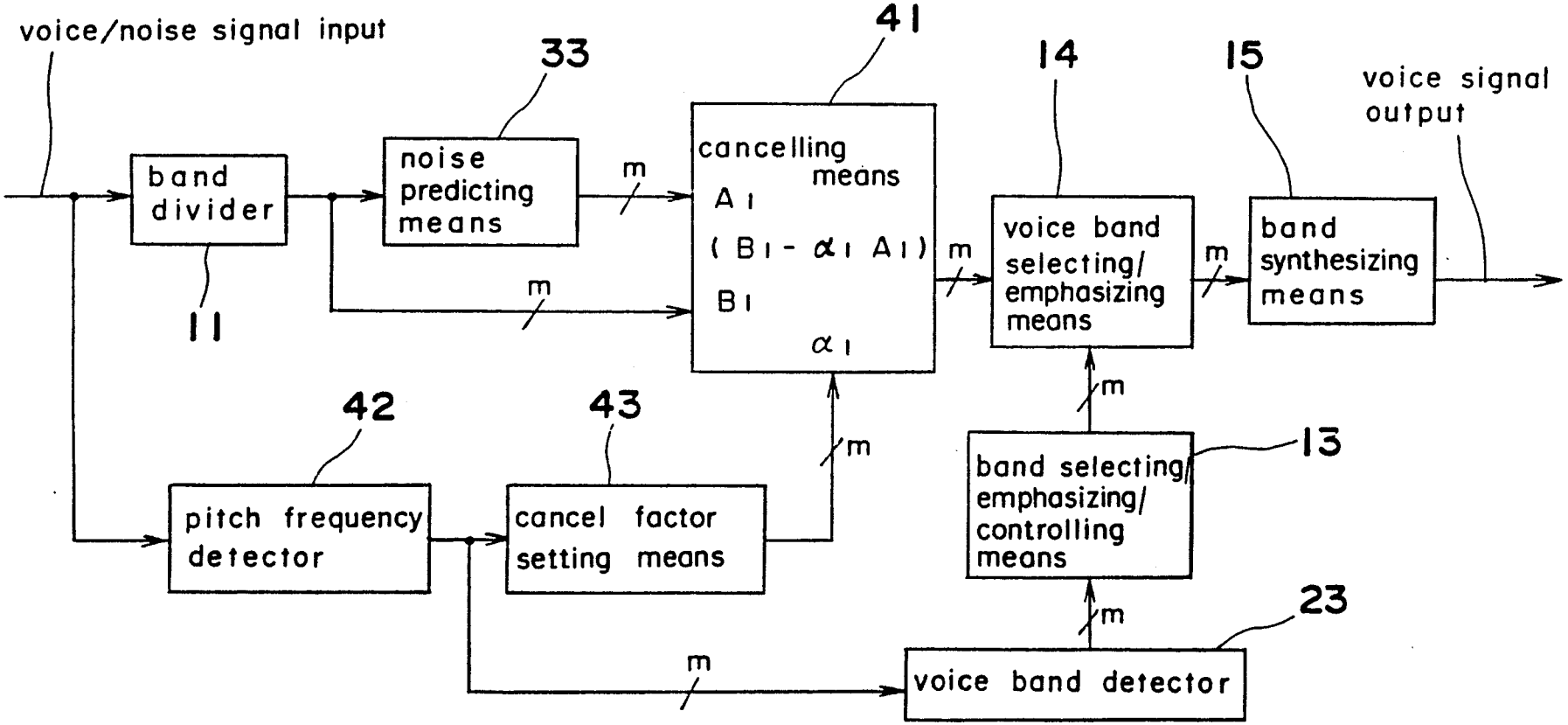
FIG. 16 is a block diagram of a voice signal processor according to a third embodiment of the present invention.

FIG. 16 is a block diagram of a voice signal processor according to a third embodiment of the present invention. In FIG. 16, a band dividing means 11 as an example of a frequency analyzing means divides a voice signal mixed with noise for every frequency band. An output of the band dividing means 11 is input to a noise predicting means 33 which predicts a noise component in the output. A cancelling means 41 removes the noise in the manner as will be described later. A band synthesizing means 15 is provided as an example of a signal synthesizing means.

More specifically, when a voice/noise input including noise is supplied to the band dividing means 11, the band dividing means 11 divides the input into m channels and supplied the same to the noise predicting means 33 and cancelling means 42. The noise predicting means 33 predicts a noise component for every channel from the voice/noise input divided into m channels, with supplying the same to the cancelling means 41. The noise is predicted, for example, as shown in FIG. 22, supposing that a frequency is represented on an x axis, a sound level on a y axis and time on a z axis, respectively, data p1,p2, . . . , pi are collected when a frequency is f1 and a subsequent data pj is predicted. For instance, an average of the noise portions p1–pi is rendered pj. Or, when the voice signal portions continue, an attenuation factor is multiplied with pj. When the m-channel signal is supplied to the cancelling means 41 from the band dividing means 11 and noise predicting means 33, the cancelling means 41 cancels the noise for every channel through subtraction or the like in compliance with a cancellation factor input thereto. In order words, the predicted noise portion is multiplied by the cancellation factor, thereby cancelling the noise. In general, the cancellation in time axis is carried out, e.g., as shown in FIGS. 23(A)–23(F). That is, an predicted noise waveform (FIG. 23(B)) is subtracted from the input voice signal mixed with noise (FIG. 23(A)). In consequence, only a voice signal is obtained (FIG. 23(F)).

According to the present embodiment, the cancellation is made based on the frequency. The voice signal mixed with noise (FIG. 23(A)) is Fourier-transformed (FIG. 23(C)), from which a spectrum of the predicted noise (FIG. 23(D)) is subtracted (FIG. 23(E)) and inversely Fourier-transformed, thereby obtaining a voice signal without noise (FIG. 23(F)).

A pitch frequency detecting means 42 detects a pitch frequency of a voice of the voice/noise input, supplies the same to cancellation factor setting means 43. The pitch frequency of the voice referred to above is obtained in various kinds of methods as tabulated in Table 1 below.

TABLE 1

| Class | Pitch Extracting Method | Feature |
|---|---|---|
| I Waveform Processing | (1) Parallel Processing | To decide by majority among 6 pitch frequencies extracted by a simple waveform peak detector. |
| | (2) Data Reduction | To reduce data except pitch pulse candidates from waveform data through various logical manipulations. |
| | (3) Zero Crossing Count | To note repeating patterns related to the number of zero crossing points of waveform. |
| | (4) Self Correlation | To make flat a spectrum by self-correlation factor of voice waveform and by center clip and to simplify operation by peak clip. |
| II Correlation Processing | (5,a) Transformed Correlation | To simplify operation by self-correlation factor of remaining difference signal of LPC analysis, LPF and polarization of remaining difference signal. |
| | (5,b) SIFT algorithm | To do LPC analysis after down-sampling of voice waveform thereby making a spectrum flat by inverse filter. Time accuracy is recovered by interpolation of correlation factor. |
| | (6) AMDF | To detect periodicity by AMDF. Extraction by AMDF of remaining difference signal is also possible. |
| | (7) Cepstrum | To separate envelope and minute structure of spectrum by Fourier-transformation of logarithm of power spectrum. |
| III Spectrum Processing | (8) Period Histogram | To determine histogram of harmonic components of fundamental frequency on spectrum thereby to determine pitch by common measure of harmonic components. |

The pitch frequency detecting means 42 may be replaced by a different means for detecting the voice portion.

The cancellation factor setting means 43 sets 8 cancellation factors on the basis of the pitch frequency obtained by the detecting means 42, and supplies the cancellation factors to the cancelling means 41.

Figure 21:
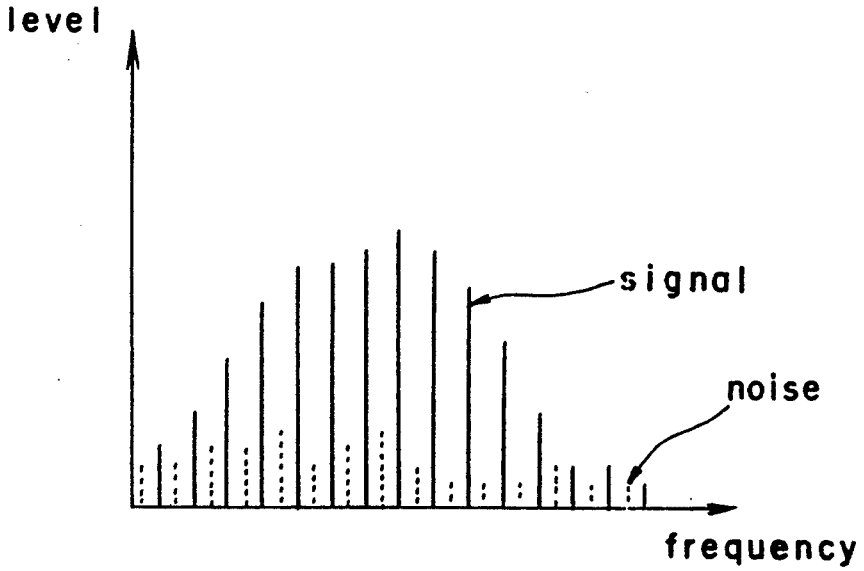
FIG. 21 is a graph explanatory of the voice band and noise band in the present invention.

The voice band detecting means 23 detects the frequency band of the voice signal portion by utilizing the pitch frequency detected by the pitch frequency detecting means 42. For example, the voice band detecting means 23 utilizes the result of the Cepstrum analysis to detect the voice band. The relationship between the voice band and noise band in terms of a frequency is generally as indicated in FIG. 21 wherein the voice signal band is expressed by S, while the noise band is designated by N.

The band selecting/emphasizing/controlling means 13 outputs a control signal to emphasize the voice band on the basis of the voice band information obtained by the detecting means 23.

The voice band selecting/emphasizing means 14, when receiving a voice signal mixed with noise from the cancelling means 41, selects and emphasizes the voice band in accordance with the control signal from the controlling means 13.

The band synthesizing means 15 synthesizes the signal emphasized by the emphasizing means 14, e.g., the synthesizing means 15 is constituted of an inverse Fourier-transformer.

The voice signal processor having the abovedescribed construction operates as follows.

Figure 24A:
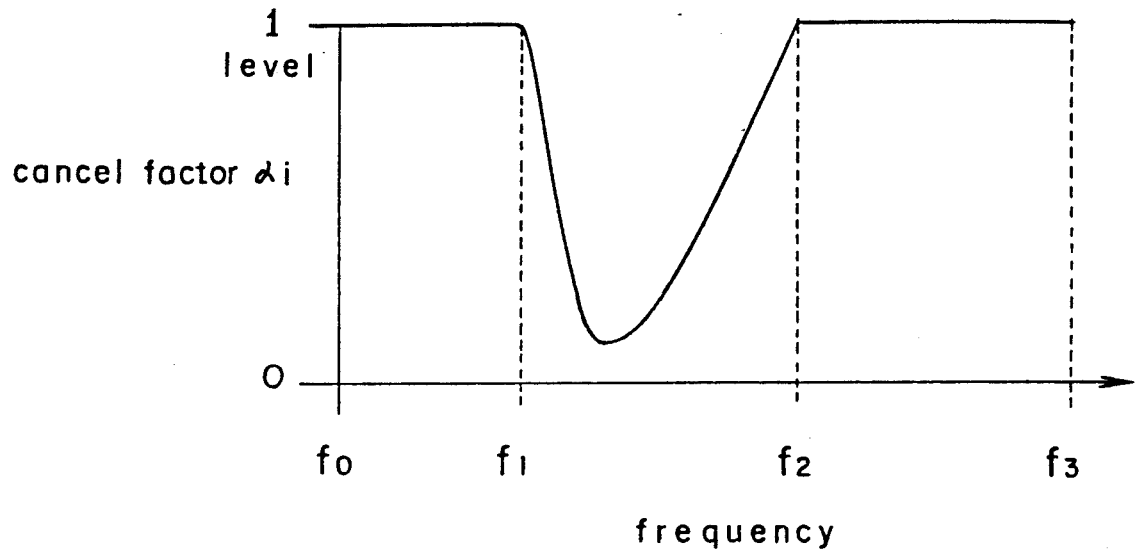
FIGS. 24(A) and 24(B) are graphs explanatory of a cancellation factor used in the present invention.
Figure 24B:
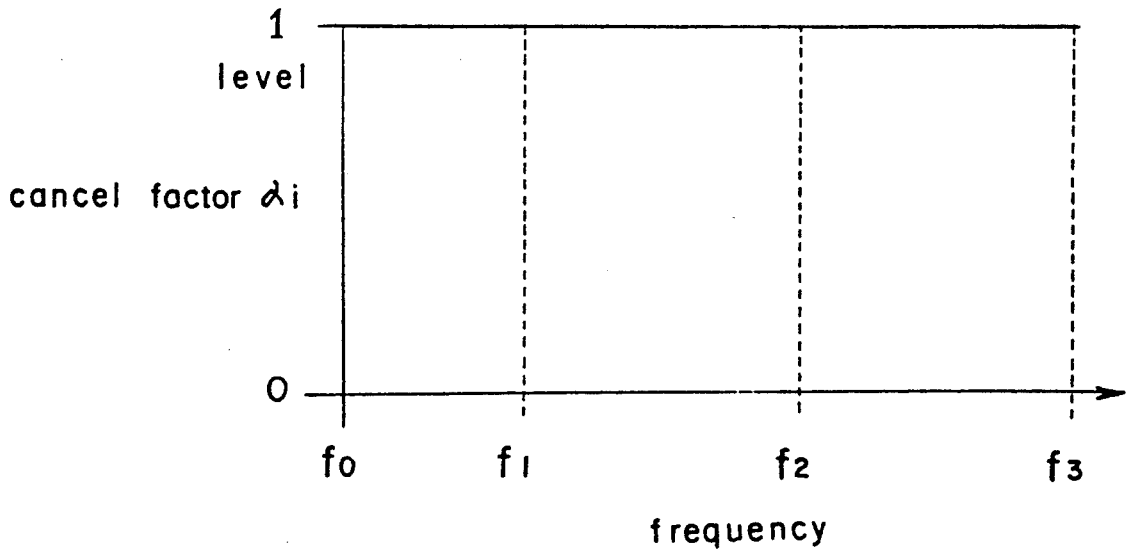
Figure 25:
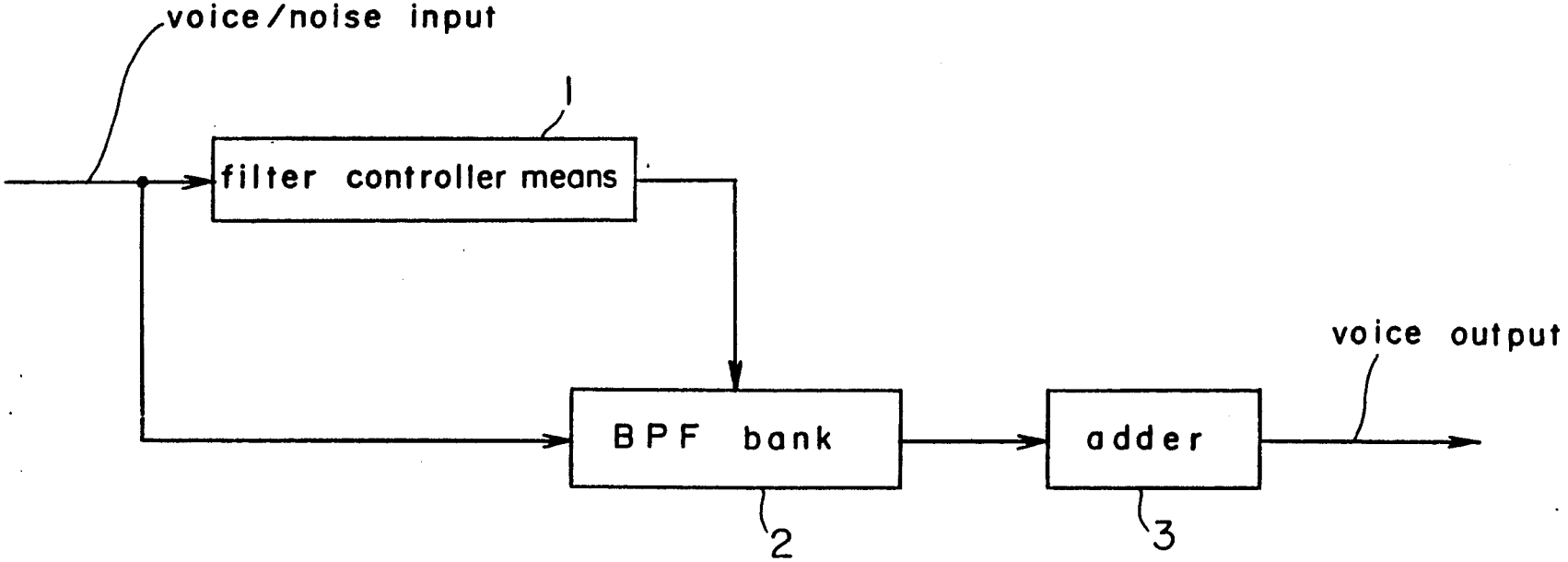
Fig. 25 PRIOR ART
FIG. 25 is a block diagram of a conventional voice signal processing apparatus.

A voice/noise input including noise is divided into m channels by the band dividing means 11. The noise predicting means 33 predicts a noise component for every channel. The noise component of the signal divided by the dividing means 11 and supplied from the noise predicting means 33 is removed by the cancelling means 41. The removing rate of the noise component at this time is suitably set so that the clearness of the signal is increased for every channel subsequent to an input of the cancellation factor. For example, even if noise exists where the voice signal is present, the cancellation factor is made smaller so as not to remove the noise too much, thereby upgrading the clearness of the signal. Speaking more in detail, the removing rate of the noise component is set for every channel by the cancellation factor supplied from the setting means 43. In other words, supposed that the predicted noise component is a1, a signal mixed with noise is bi and a cancellation factor is $\alpha i$, an output ci of the cancelling means 41 becomes (bi-$\alpha$ixai). Meanwhile, the cancellation factor is determined on the basis of information from the pitch frequency detecting means 42. That is, the pitch frequency detecting means 42 receives the voice/noise input and detects a pitch frequency of the voice. The cancellation factor setting means 43 sets such a cancellation factor as indicated in FIG. 24. FIG. 24(A) shows a cancellation factor in each frequency band, $f_0$–$f_3$ indicating the whole band of the voice/noise input. The whole band $f_0$–$f_3$ is divided into m channels to set the cancellation factor. The band $f_1$–$f_2$ particularly includes the voice, which is detected by using the pitch frequency. In this manner, the cancellation factor is set smaller (closer to 0) in the voice band, and accordingly the noise is less removed. The clearness is improved after all, since the hearing ability of a man can distinguish voice even in existence of some noise. The cancellation factor is set 1 in the unvoiced bands $f_0$–$f_1$ and $f_2$–$f_3$, and the noise can be sufficiently removed. A cancellation factor shown in FIG. 24(B), i.e., 1 is used when the presence of noise without voice at all is clear. In this case, noise can be removed enough with the cancellation factor 1. When it is continued that a vowel sound never appears seen from the peak frequency, it cannot be judged as a voice signal, but is judged as noise. Therefore, the cancellation factor of FIG. 24(B) is used in such case as above. It is desirable to switch the cancellation factors of FIGS. 24(A) and 24(B) properly.

Meantime, the voice band detecting means 23 detects the voice band on the basis of the pitch frequency information detected by the detecting means 42. The band selecting/emphasizing/controlling means 13 generates a control signal based on the voice band information of the detecting means 23. The voice level in the voice band of the signal from which noise is removed by the cancelling means 41 is emphasized relatively by the voice band selecting/emphasizing means 14 on the basis of the control signal from the controlling means 13.

The voice signal mixed with noise having the voice level emphasized is synthesized and output by the band synthesizing means 15.

Figure 17:
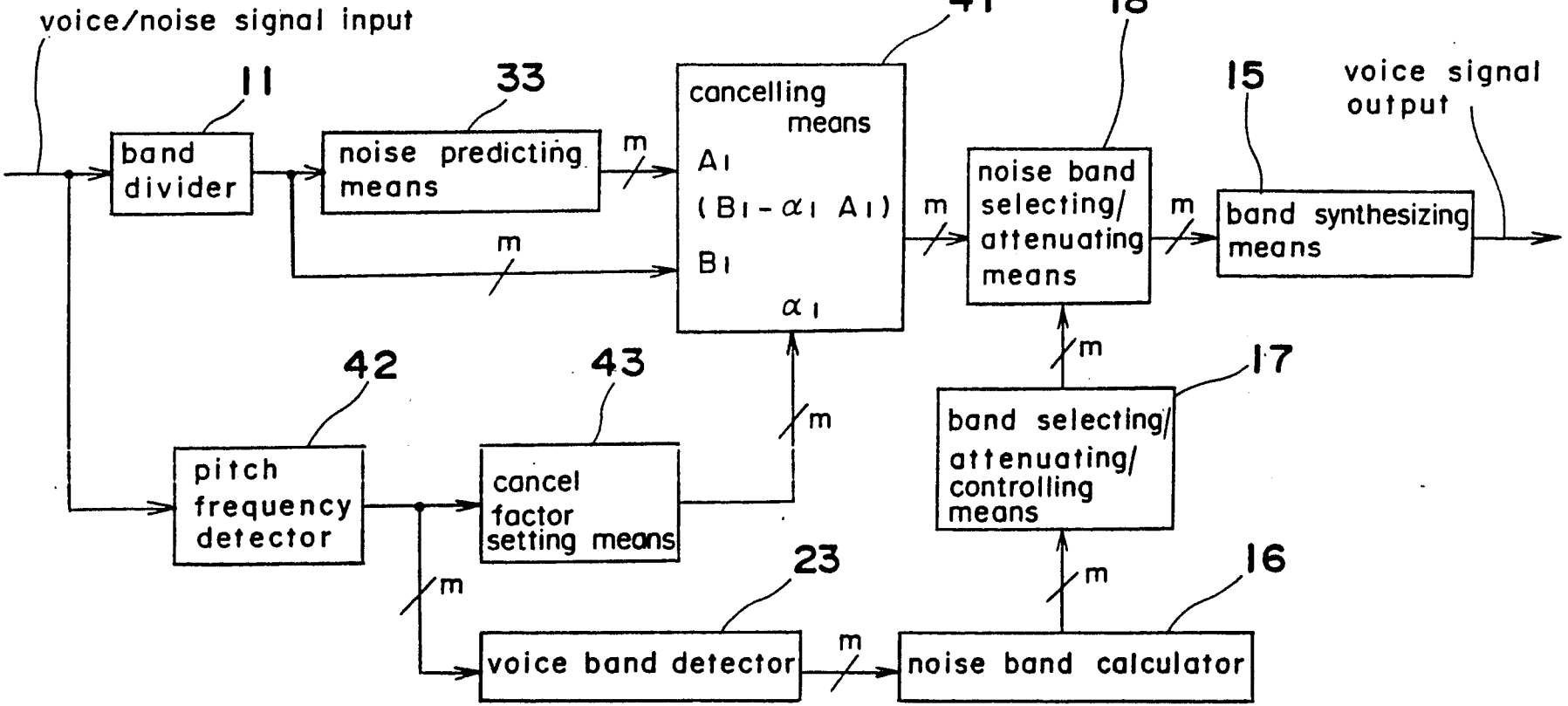
FIG. 17 is a block diagram of a modification of the voice signal processor of FIG. 16.

FIG. 17 is a block diagram of a modification of the voice signal processor of FIG. 16, which is different from FIG. 16 in a point that the noise level in the noise band is attenuated.

More specifically, according to the instant embodiment, the band dividing means 11, noise predicting means 33, cancelling means 41, pitch frequency detecting means 42, cancellation factor setting means 43 and voice band detecting means 23 are all identical to those in the embodiment shown in FIG. 16, and the description thereof will be abbreviated here.

An output of the voice band detecting means 23 is input to a noise band calculating means 16. The noise band calculating means 16 calculates the noise band on the basis of the voice band information obtained by the detecting means 23, for example, it judges a band from which the voice band is removed as a noise band. A band selecting/attenuating/controlling means 17 outputs an attenuating/controlling signal on the basis of the noise band information calculated by the calculating means 16. A noise band selecting/attenuating means 18 attenuates, in accordance with a control signal from the controlling means 17, the signal level in the noise band of the signal sent from the cancelling means 41. Accordingly, the signal in the voice band can be emphasized relatively.

According to the embodiment of FIG. 17, since the signal level in the noise band is attenuated, the voice band is eventually emphasized relative to the noise band, thereby improving the S/N ratio.

Figure 18:
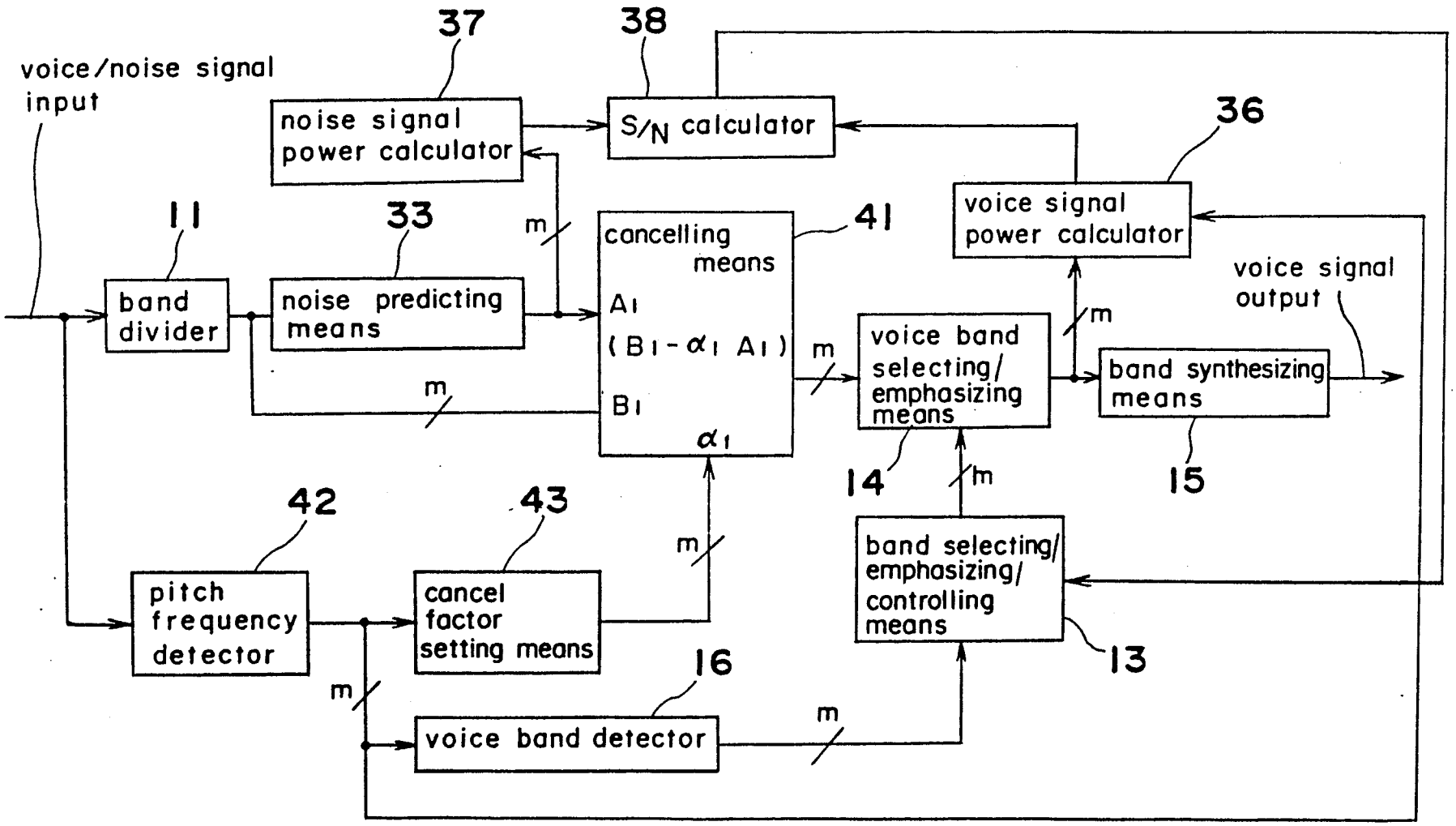
FIG. 18 is a block diagram of a modification of the voice signal processor of FIG. 16.

FIG. 18 shows a block diagram of a modified embodiment of the voice signal processor of FIG. 16, in which the band selecting/emphasizing/controlling means 13 is restricted in a predetermined manner so as to make the improvement of the S/N ratio appropriate.

In other words, a noise signal power calculating means 37 is provided to calculate the size of the noise based on an output from the noise predicting means 33. On the other hand, a voice signal power calculating means 36 calculates the size of a voice signal emphasized by the voice band selecting/emphasizing means 14. The voice signal calculated by the calculating means 36 and the noise power calculated by the calculating means 37 are both input to an S/N ratio calculating means 38, where the S/N ratio is calculated. The calculated S/N ratio is input to the band selecting/emphasizing/controlling means 13 which subsequently outputs a control signal to the voice band selecting/emphasizing means 14 so that the calculated S/N ratio be a predetermined target S/N value. This target value is, for example, 1/5. The target S/N value means prevent the voice signal from being much too emphasized with respect to the noise.

Figure 19:
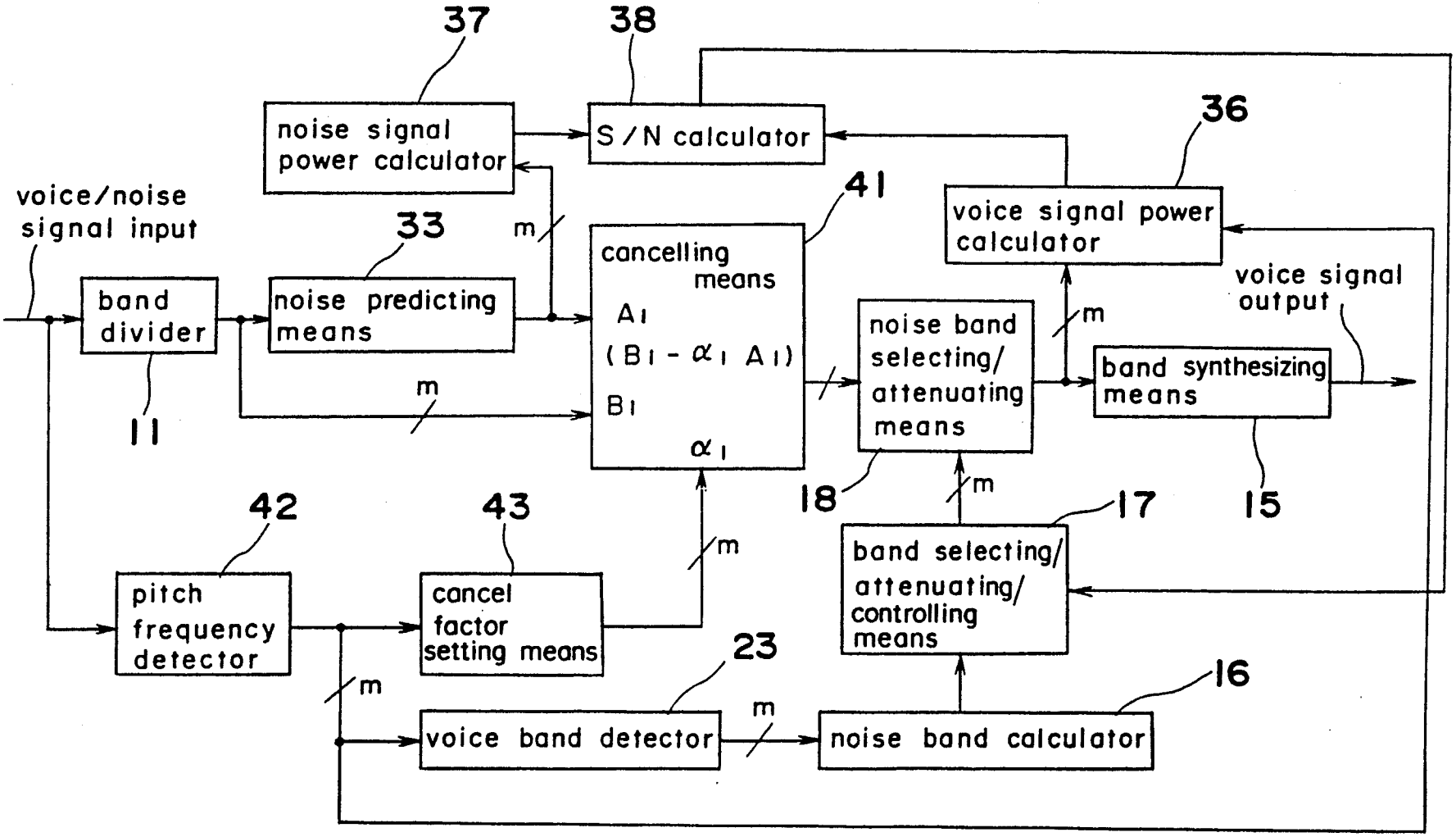
FIG. 19 is a block diagram of a modification of the voice signal processor of FIG. 17.

FIG. 19 is a block diagram of a modification of the voice signal processor of FIG. 17. In the embodiment of FIG. 19, a predetermined restriction is placed on the function of the band selecting/attenuating/controlling means 17 to achieve a proper improvement of the S/N ratio.

In other words, as mentioned above with reference to FIG. 18, the noise signal power calculating means 37 calculates the size of the noise based on an output from the noise predicting means 33. The voice signal power calculating means 36 calculates the size of the voice signal which is relatively emphasized through attenuation of the noise by the attenuating means 18. The S/N ratio calculating means 38, upon receipt of the voice signal calculated by the calculating means 36 and the noise power calculated by the calculating means 37, calculates the S/N ratio. As the calculated S/N ratio is input to the band selecting/attenuating/controlling means 17 from the S/N ratio calculating means 38, a control signal is output to the noise band selecting/attenuating means 18.

Although the voice band detecting means, voice band selecting/emphasizing means, etc. in the above embodiments can be realized in the software of a computer, a special hardware circuit with respective functions may be utilized .

As is clear from the above description of the embodiments of the voice signal processor, the cancellation factor is used in order to predict the noise component for the noise cancellation, and moreover, the voice level in the voice band is emphasized or the noise level in the noise band is attenuated, thereby achieving a better noise-suppressed voice signal.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A voice signal processor which comprises:

a channel dividing means for dividing an input signal including noise into a plurality of frequency channels;

a voice channel detecting means for detecting a portion in the voice channel of said divided signal for every channel from said channel dividing means;

a voice channel selecting gain modifying means for emphasizing a voice signal channel of said signal including noise relative to a noise signal channel on the basis of voice channel information detected by said voice channel detecting means; and a channel controller means for forming said signal emphasized by said selecting/gain modifying means;

wherein said voice channel detecting means is provided with: a Cepstrum analyzing means for performing a Cepstrum analysis on the divided input signal; a peak detecting means for detecting a peak on the basis of the analyzing result; a format analyzing means for performing a formant analysis on the basis of said Cepstrum analysis result; and a voice channel detecting circuit to detect the voice channel using the formant information of aid formant analyzing means and the peak detected by said peak detecting means.

2. A voice signal processor which comprises:

a channel dividing means for dividing an input signal including noise into a plurality of frequency channels;

a voice channel detecting means for detecting a portion in the voice channel of the signal divided by said channel dividing means for every channel;

a noise channel calculating means for calculating the noise channel on the basis of the voice channel information detected by said voice channel detecting means;

a channel selecting/attenuating/controlling means for outputting a control signal to emphasize the noise channel calculated by said noise channel calculating means;

a noise channel selecting/attenuating means for selecting the noise channel of the divided signal including noise input thereto from said channel dividing means in accordance with the control signal from said channel selecting/attenuating/controlling means, so as to thereby attenuate said noise channel only; and a channel controller means for forming the signal attenuated by said channel band selecting/attenuating means;

wherein said voice channel detecting means is provided with: a Cepstrum analyzing means for performing a Cepstrum analysis on the divided input signal; a peak detecting means for detecting a peak on the basis of the Cepstrum analysis result; a formant analyzing means for performing a formant analysis on the basis of the Cepstrum analysis result, and a voice channel detecting circuit to detect the voice channel using the formant information analyzed by said formant analyzing means and the peak detected by said peak detecting means.

3. A voice signal processor which comprises:

a channel dividing means for dividing an input signal including noise into a plurality of frequency channels;

a voice channel detecting means for detecting a portion in the voice channel of the divided signal for every channel from said channel dividing means;

a channel selecting/gain modifying/controlling means for outputting a control signal to emphasize the voice channel on the basis of the voice channel information detected by said voice channel detecting means;

a noise channel calculating means for calculating the noise channel on the basis of the voice channel information detected by said voice channel detecting means;

a channel selecting/attenuating/controlling means for outputting a control signal to emphasize the noise channel calculated by said noise channel calculating means;

a gain modifying/attenuating means for selecting the voice channel of the signal including noise and divided by said channel dividing means in accordance with the control signal from said channel selecting/gain modifying/controlling means, so as to thereby emphasize said voice channel only, or for selecting the noise channel in accordance with the control signal from said channel selecting/attenuating/controlling means, so as to thereby attenuate said noise channel only; and a channel controller means for forming the gain modified/attenuated signal by said gain modifying/attenuating means.

4. A voice signal processor which comprises:

channel dividing means for dividing an input signal including noise into a plurality of frequency channels;

a voice discriminating means for discriminating a voice portion of the signal divided by said channel dividing means;

a noise predicting means for predicting noise in said voice portion using the voice portion information discriminated by said voice discriminating means;

a noise canceling means for subtracting a noise value predicted by said noise predicting means from the signal divided by said channel dividing means;

a voice channel detecting means for detecting a portion in the voice channel of said divided signal for every channel;

a voice channel selecting/gain modifying means for emphasizing a voice signal channel of the signal from which noise is canceled by said noise canceling means relative to a noise signal channel on the basis of the voice channel information detected by said voice channel detecting means; and a channel controller means for forming the signal by said voice channel selecting/gain modifying means.

5. A voice signal processor which comprises:

a channel dividing means for dividing an input signal including noise into a plurality of frequency channels;

a Cepstrum analysing means for performing a Cepstrum analysis on the signal divided by said channel dividing means for every channel;

a peak detecting means for detecting a peak on the basis of the Cepstrum analysis result;

a voice discriminating circuit which discriminates a voice portion using the peak detected by said peak detecting means;

a noise predicting means for predicting noise in said voice portion using the voice portion information obtained by said voice discriminating circuit;

a noise canceling means for subtracting a noise value predicted by said noise predicting means from said divided signal;

a voice channel detecting circuit for detecting the voice channel using the peak detected by said peak detecting means;

a channel selecting/gain modifying/controlling means for outputting a control signal to emphasize the voice channel on the basis of the voice channel information detected by said voice channel detecting circuit;

a voice channel selecting/gain modifying means for selecting the voice channel of the signal from which noise is removed by said noise canceling means in accordance with the control signal of said channel selecting/gain modifying/controlling means, so as to thereby emphasize said voice channel only; and a channel controller means for forming the signal gain controller by said voice channel selecting/gain controlling means.

6. A voice signal processor as set forth in claim 5, further comprising a formant analyzing means for performing a formant analysis on the Cepstrum of said Cepstrum analyzing means, so that said voice discriminating circuit also discriminates the voice portion using the formant analysis result.

7. A voice signal processor which comprises:

a channel dividing means for dividing an input signal including noise into a plurality of frequency channels;

a Cepstrum analyzing means for performing a Cepstrum analysis on the signal divided by said channel dividing means for every channel;

a peak detecting means for detecting a peak on the basis of the Cepstrum analysis result;

a voice discriminating circuit which discriminates a voice portion using the peak detected by said peak detecting means;

a noise predicting means for predicting noise in the voice portion using the voice portion information obtained by said voice discriminating circuit;

a noise canceling means for subtracting a noise value predicted by said noise predicting means from said divided signal;

a voice channel detecting circuit for detecting the voice channel using the peak detected by said peak detecting means;

a noise channel calculating means for calculating the noise channel on the basis of the voice channel information detected by said voice band detecting circuit;

a channel selecting/attenuating/controlling means for outputting a control signal to attenuate the noise channel calculated by said noise channel calculating means;

a noise channel selecting/attenuating means for selecting the noise channel of the input signal from which noise is canceled by said noise canceling means in accordance with the control signal from said band selecting/attenuating/controlling means, so as to thereby attenuate said voice channel only; and a channel controller means for forming the signal attenuated by said noise channel selecting/attenuating means.

8. A voice signal processor as set forth in claim 7, further comprising a formant analyzing means for performing a formant analysis on the Cepstrum of said Cepstrum analyzing means, so that said voice discriminating circuit also discriminates the voice portion using the formant analysis result.

9. A voice signal processor which comprises:

a channel dividing means for dividing an input signal including noise into a plurality of frequency channels;

a Cepstrum analyzing means for performing a Cepstrum analysis on the signal divided by said channel dividing means for every channel;

a peak detecting means for detecting a peak on the basis of the Cepstrum analysis result;

a voice discriminating circuit which discriminates a voice portion using the peak detected by said peak detecting means;

a noise predicting means for predicting noise in the voice portion using the voice portion information obtained by said voice discriminating circuit;

a noise canceling means for subtracting a noise value predicted by said noise predicting means from said divided signal;

a voice channel detecting circuit for detecting the voice channel using the peak detected by said peak detecting means;

a channel selecting/gain modifying/controlling means for outputting a control signal to emphasize the voice channel on the basis of the voice channel information detected by said voice channel detecting circuit;

a noise channel calculating means for calculating the noise channel on the basis of the voice channel information detected by said voice channel detecting circuit;

a channel selecting/attenuating/controlling means for outputting a control signal to emphasize the noise channel calculated by said noise channel calculating means;

a gain modifying /attenuating means for selecting the voice channel of the signal from which noise is canceled by said noise canceling means in accordance with the control signal of said channel selecting/gain modifying/attenuating means.

10. A voice signal processor which comprises:

a channel dividing means for dividing an input signal including noise into a plurality of frequency channels;

a Cepstrum analyzing means for performing a Cepstrum analysis on the signal divided by said channel dividing means for every channel;

a peak detecting means for detecting a peak on the basis of the Cepstrum analysis result;

a voice discriminating circuit which discriminates a voice portion using the peak detected by said peak detecting means;

a noise predicting means for predicting noise of the voice portion using the voice portion information obtained by said voice discriminating circuit;

a noise canceling means for subtracting a noise value predicted by said noise predicting means from said divided signal;

a voice channel detecting circuit for detecting the voice channel using the peak detected by said peak detecting means;

a channel selecting/gain modifying/controlling means for outputting a control signal to emphasize the voice channel on the basis of the voice channel information detected by said voice channel detecting circuit;

a voice channel selecting/gain modifying means for selecting the voice channel of the input signal from which noise is removed by said noise canceling means in accordance with the control signal of said channel selecting/gain modifying/controlling means, so as to thereby emphasize said voice channel only;

a channel means for forming the signal emphasized by said voice channel selecting/gain modifying means;

a noise power calculating means for calculating the size of the input noise predicted by said noise predicting means;

a voice signal power calculating means for calculating the size of the voice signal emphasized by said voice band selecting/gain modifying means; and a S/N ratio calculating means for calculating the S/N ratio between the voice signal calculated by said voice signal power calculating means and the noise power calculated by said noise power calculating means;

wherein said channel selecting/gain modifying/controlling means outputs a control signal to said voice channel selecting/gain modifying means so that the S/N ratio calculated by said S/N calculating means and input to said controlling means becomes a predetermined target S/N ratio.

11. A voice signal processor which comprises:

a channel dividing means for dividing an input signal including noise into a plurality of frequency channels;

a Cepstrum analyzing means for performing a Cepstrum analysis of the signal divided by said channel dividing means for every channel;

a peak detecting means for detecting a peak on the basis of the Cepstrum analysis result;

a voice discriminating circuit which discriminates a voice portion using the peak detected by said peak detecting means;

a noise predicting means for predicting noise of the voice portion using the voice portion information obtained by said voice discriminating circuit;

a noise canceling means for subtracting a noise value predicted by said noise predicting means from said divided signal;

a voice channel detecting circuit for detecting the voice channel using the peak detected by said peak detecting means;

a noise channel calculating means for calculating the noise channel on the basis of the voice channel information detected by said voice channel detecting circuit;

a channel selecting/attenuating/controlling means for outputting a control signal to emphasize the noise channel calculated by said noise channel calculating means;

a noise channel selecting/attenuating means for selecting the noise channel of the input signal from which noise is canceled by said noise canceling means in accordance with the control signal of said channel selecting/attenuating/controlling means so as to thereby attenuate said noise channel only;

a channel controller means for forming the signal attenuated by said noise channel selecting/attenuating means;

a noise power calculating means for calculating the size of the input noise predicted by said noise predicting means;

a voice signal power calculating means for calculating the size of the voice signal which is relatively emphasized by said noise channel selecting/attenuating means; and a S/N ratio calculating means for calculating the S/N ratio between the voice signal calculated by said voice signal power calculating means and the noise power calculated by said noise power calculating means;

wherein said band selecting/attenuating/controlling means outputs a control signal to said noise channel selecting/attenuating means so that the calculated S/N ratio input to said controlling means becomes a predetermined target S/N value.

12. A voice signal processor which comprises:

a channel dividing means for dividing an input voice signal including noise into a plurality of frequency channels;

a noise predicting means for predicting a noise component of the signal input thereto from said channel dividing means;

a pitch frequency detecting means for detecting the pitch frequency of said input signal including noise;

a cancellation factor setting means for setting a cancellation factor corresponding to the pitch frequency output from said pitch frequency detecting means;

a noise canceling means to which are input an output from said noise predicting means, an output from said channel dividing means and a signal from said cancellation factor setting means for canceling the noise component of said output from said channel dividing means in consideration of the canceling rate;

a voice band detecting means for detecting a portion in the voice channel of said input signal using the pitch frequency detected by said pitch frequency detecting means;

a channel selecting/gain modifying/controlling means for outputting a control signal to emphasize the voice channel detected by said voice channel detecting means;

a voice channel selecting/gain modifying means for emphasizing a voice signal channel of the signal from which noise is canceled by said noise canceling means relative to a noise signal channel in accordance with the control signal of said band selecting/gain modifying/controlling means; and a channel controller means for forming the signal emphasized by said voice channel selecting/gain modifying means.

13. A voice signal processor which comprises:

a channel dividing means for dividing an input voice signal including noise into a plurality of frequency channels;

a noise predicting means for predicting a noise component of the output input thereto from said channel dividing means;

a pitch frequency detecting means for detecting the pitch frequency of said input signal including noise;

a cancellation factor setting means for setting a cancellation factor corresponding to the pitch frequency output from said pitch frequency detecting means;

a noise canceling means to which are input an output of said noise predicting means, an output of said channel dividing means and a signal of said cancellation factor setting means channel dividing means in consideration of the canceling rate;

a voice channel detecting means for detecting a portion in the voice channel of said input signal using the pitch frequency detected by said pitch frequency detecting means;

a noise channel calculating means for calculating the noise channel on the basis of the voice channel information detected by said voice channel detecting means;

a channel selecting/attenuating/controlling means for outputting a control signal to attenuate the noise channel calculated by said noise band calculating means;

a noise channel selecting/attenuating means for selecting the noise channel of the input signal from which noise is canceled by said noise canceling means in accordance with the control signal of said channel selecting/attenuating/controlling means, so as to thereby attenuate said noise channel only; and a channel controller means for forming the signal attenuated by said noise channel selecting/attenuating means.

14. A voice signal processor which comprises:

a channel dividing means for dividing an input voice signal including noise into a plurality of frequency channels;

a noise predicting means for predicting a noise component of the output input thereto from asia channel dividing means;

a pitch frequency detecting means for detecting the pitch frequency of said input signal including noise;

a cancellation factor setting means for setting a cancellation factor corresponding to the pitch frequency output from said pitch frequency detecting means;

a noise canceling means to which are input an output of said noise predicting means, an output of said channel dividing means, and a signal of said cancellation factor setting means for canceling the noise component of the output of said channel dividing means in consideration of the canceling rate;

a voice channel detecting means for detecting a portion in the voice channel of said input signal using the pitch frequency detected by said pitch frequency detecting means;

a channel selecting/gain modifying/controlling means for outputting a control signal to emphasize the voice channel detected by said voice channel detecting means;

a voice channel selecting/gain modifying means for emphasizing a voice signal channel of the signal from which noise is canceled by said noise canceling means relative to a noise signal channel in accordance with the control signal of said band selecting/gain modifying/controlling means;

a channel controller means for forming the signal emphasized by said voice channel selecting/emphasizing means;

a noise power calculating means for calculating the size of the noise predicted by said noise predicting means and input thereto;

a voice signal power calculating means for calculating the size of the voice signal emphasized by said voice band selecting/gain modifying means; and a S/N ratio calculating means for calculating the S/N ratio between the voice signal calculated by said voice signal power calculating means and the noise power calculated by said noise power calculating means;

wherein said channel selecting/gain modifying/controlling means outputs a control signal to said voice channel selecting/controlling means so that the S/N ratio calculated by said S/N ratio calculating means and input to the selecting/gain modifying-/controlling means becomes a predetermined target S/N value.

15. A voice signal processor which comprises:

a channel dividing means for dividing an input voice signal including noise into a plurality of frequency channel;

a noise predicting means for predicting a noise component of the output input thereto from said channel dividing means;

a pitch frequency detecting means for detecting the pitch frequency of said input signal including noise;

a cancellation factor setting means for setting a cancellation factor corresponding to the pitch frequency output from said pitch frequency detecting means;

a noise canceling means to which are input an output of said noise predicting means, an output of said channel dividing means and a signal form said cancellation factor setting means for canceling the noise component of the output of said channel dividing means in consideration of the canceling rate;

a voice channel detecting means for detecting a portion of the voice channel in said input signal using the pitch frequency detected by said pitch frequency detecting means;

a noise channel calculating means for calculating the noise channel on the basis of the voice channel information detected by said voice channel detecting means;

a channel selecting/attenuating/controlling means for outputting a control signal to attenuate the noise channel calculated by said noise channel calculating means;

a noise channel selecting/attenuating means for selecting the noise channel of the input signal from which noise is canceled by said noise canceling means in accordance with the control signal of said band selecting/attenuating/controlling means, so as to thereby attenuate said noise channel only; and a channel controller means for forming the signal attenuated by said noise channel selecting/attenuating means;

a noise power calculating means for calculating the size of the noise predicted by said noise predicting means and input thereto;

a voice signal power calculating means for calculating the size of the voice signal relatively emphasized by said noise channel selecting/attenuating means; and a S/N ratio calculating means for calculating the S/N ratio between the voice signal calculated by said voice signal power calculating means and the noise power calculated by said noise power calculating means;

wherein said band selecting/attenuating/controlling means outputs a control signal to said noise channel selecting/attenuating means so that the S/N ratio calculated by said S/N ratio calculating means and input to the controlling means becomes a predetermined target S/N value.

* * * * *